US011149698B2

(12) United States Patent
Dudar

(10) Patent No.: US 11,149,698 B2
(45) Date of Patent: Oct. 19, 2021

(54) SYSTEMS AND METHODS FOR FUEL SYSTEM RECIRCULATION VALVE DIAGNOSTICS

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 142 days.

(21) Appl. No.: 16/012,549

(22) Filed: Jun. 19, 2018

(65) Prior Publication Data

US 2019/0383246 A1 Dec. 19, 2019

(51) Int. Cl.

| | |
|---|---|
| ***F02M 26/49*** | (2016.01) |
| ***F02M 26/10*** | (2016.01) |
| ***F02M 26/16*** | (2016.01) |
| *F02M 26/00* | (2016.01) |

(52) U.S. Cl.

CPC ..... *F02M 26/49* (2016.02); *F02M 26/10* (2016.02); *F02M 26/16* (2016.02); *F02M 2026/0025* (2016.02)

(58) Field of Classification Search

CPC ..... F02M 26/49; F02M 26/10; F02M 26/16; F02M 2026/0025

USPC ..... 123/568.16

See application file for complete search history.

(56) References Cited

U.S. PATENT DOCUMENTS

| | | | | |
|---|---|---|---|---|
| 5,873,352 | A * | 2/1999 | Kidokoro | F02M 25/0809 123/520 |
| 9,050,885 | B1 * | 6/2015 | Dudar | B60K 11/085 |
| 9,732,706 | B2 | 8/2017 | Dudar et al. | |
| 9,745,907 | B2 * | 8/2017 | Dudar | F02M 25/0836 |
| 9,751,396 | B2 * | 9/2017 | Dudar | F02D 41/222 |
| 9,850,855 | B2 * | 12/2017 | Matsunaga | F02M 25/0836 |
| 2002/0162457 | A1 * | 11/2002 | Hyodo | B01D 53/0454 96/109 |
| 2005/0229689 | A1 * | 10/2005 | Miyahara | F02M 25/08 73/114.41 |
| 2012/0211087 | A1 * | 8/2012 | Dudar | F02D 41/0032 137/12 |
| 2015/0158377 | A1 * | 6/2015 | Dudar | B60K 11/085 701/22 |

(Continued)

OTHER PUBLICATIONS

Dudar, A., "Systems and Methods for Reducing Vehicle Emissions," U.S. Appl. No. 15/936,012, filed Mar. 26, 2018, 70 pages.

*Primary Examiner* — David Hamaoui
*Assistant Examiner* — John D Bailey
(74) *Attorney, Agent, or Firm* — Geoffrey Brumbaugh; McCoy Russell LLP

(57) ABSTRACT

Methods and system are provided for indicating whether a variable orifice valve positioned in a fuel vapor recovery line of a vehicle fuel system is degraded. In one example, a method may include actively manipulating a pressure in the fuel system during a refueling event, and indicating whether the variable orifice valve is degraded based on a loading rage of a fuel vapor storage canister with fuel vapors while the pressure is actively manipulated. In this way, it may be determined as to whether the variable orifice valve is stuck in a high-flow or a low-flow position such that mitigating action may be taken to reduce or avoid release of undesired evaporative emissions to atmosphere.

18 Claims, 7 Drawing Sheets

(56) References Cited

U.S. PATENT DOCUMENTS

| | | | | |
|---|---|---|---|---|
| 2015/0226138 | A1* | 8/2015 | Yang | F02M 25/0809 701/22 |
| 2016/0177883 | A1* | 6/2016 | Matsunaga | F02M 25/0836 123/519 |
| 2016/0209292 | A1* | 7/2016 | Dudar | F02M 25/0836 |
| 2016/0215713 | A1* | 7/2016 | Dudar | F02M 25/0809 |
| 2016/0243931 | A1* | 8/2016 | Dudar | F02D 41/003 |
| 2017/0045019 | A1* | 2/2017 | Dudar | F02M 25/0854 |
| 2017/0159585 | A1* | 6/2017 | Pursifull | F02D 41/0007 |
| 2017/0159616 | A1* | 6/2017 | Miyabe | F02D 41/22 |
| 2017/0217753 | A1 | 8/2017 | Dudar | |
| 2018/0010532 | A1 | 1/2018 | Dudar | |
| 2018/0099856 | A1* | 4/2018 | Dudar | B60K 15/03504 |

* cited by examiner

SYSTEMS AND METHODS FOR FUEL SYSTEM RECIRCULATION VALVE DIAGNOSTICS

FIELD

The present description relates generally to methods and systems for actively manipulating pressure in a vehicle fuel system during a refueling event in order to diagnose whether a variable orifice valve positioned in a fuel vapor recirculation line is stuck in one of an open or closed configuration.

BACKGROUND/SUMMARY

Vehicle emission control systems may be configured to store fuel vapors from fuel tank refueling and diurnal engine operations, and then purge the stored vapors during a subsequent engine operation. The fuel vapors may be stored in a fuel vapor canister coupled to the fuel tank which contains adsorbent material, such as activated carbon, capable of adsorbing hydrocarbon fuel vapor.

The fuel tank may be further coupled to a vapor recovery line (vapor recirculation line). The vapor recovery line may be configured to circulate and/or hold a percentage of refueling vapors, thus limiting the rate of fuel vapor canister loading. Fuel vapors may recirculate back to the fuel tank via flowing through the recirculation line and through a filler neck of the fuel tank. Further, depending on the fuel dispenser, the fuel vapors within the vapor recovery line may be returned to the fuel dispenser, thus limiting the total fuel vapor stored within the fuel vapor canister for a given refueling event. By reducing canister loading during refueling events, the canister sizing may be reduced, which may reduce costs and weight associated with the vehicle.

Fuel vapor recirculation lines include orifices to regulate the fuel vapor flow rate through the recirculation line. In many examples, such an orifice comprises a fixed orifice that is set manually via a technician. The size of such an orifice may be configured so as to maximize vapor recirculation without resulting in fuel vapors (e.g. hydrocarbons) exiting to atmosphere via an inlet at the fuel filler neck. However, such orifices of fixed size may not be robust to variability in flow rates of fuel from various fuel dispensers. For example, different fuel stations may have inherent variability in fuel flow rates (e.g. gallons per minute, or GPM). Such variability may result in canister loading of fuel vapors to a greater extent than desired under some circumstances, while resulting in the release of undesired evaporative emissions (e.g. hydrocarbons) to atmosphere via the inlet at the fuel filler neck under other circumstances.

To address such issues, a variable orifice valve (also referred to herein as a recirculation valve or variable orifice recirculation valve), may be installed in the recirculation line. Such a variable orifice valve may include an orifice that changes in size as a function of fuel station pump dispense rate. For example, at higher refueling rates it is desirable to re-route a greater amount of fuel vapors to the fuel tank rather than to the canister, thus the variable orifice valve may open to a greater extent under such conditions. Alternatively, at lower refueling rates it is desirable to re-route a lesser amount of fuel vapors to the fuel tank, thus the variable orifice valve may close to a greater extent under such conditions.

However, as the variable orifice valve ages, the variable orifice valve may stick in one of an open or closed configuration. As an example, a stuck closed variable orifice may result in an undesirable increase in canister loading. In another example where the variable orifice is stuck open, an increase in release of undesired evaporative emissions to atmosphere via the fuel filler neck inlet may result.

Diagnosing whether the variable orifice valve is stuck in one of an open or closed configuration is challenging. The inventors herein have recognized these issues, and have herein developed systems and methods to at least partially address them. In one example, a method for a vehicle comprises actively manipulating a pressure in a fuel system while fuel is being added thereto, the fuel system fluidically coupled to an evaporative emissions system including a fuel vapor canister, and indicating whether a variable orifice valve positioned in a fuel vapor recovery line of the fuel system is degraded based on a rate of loading of the canister with fuel vapors while the pressure is actively manipulated. In this way, in response to an indication that the variable orifice valve is degraded, mitigating action may be taken which may prevent or reduce the release of undesired evaporative emissions to atmosphere.

In one example, the fuel vapor recovery line recirculates fuel vapors back to a fuel tank of the fuel system to reduce an amount of fuel vapors that loads the fuel vapor canister during refueling events. Actively manipulating the pressure may include increasing the pressure by periodically sealing the fuel system and evaporative emissions system from atmosphere, or may include decreasing the pressure by periodically fluidically coupling the fuel system and evaporative emissions system to an intake of an engine of the vehicle. The variable orifice valve may be passively mechanically actuated or may be electromechanically actuated based on an amount of pressure in the fuel system. The variable orifice valve may occupy a low-flow configuration when the pressure is below a first threshold pressure, and may occupy a high-flow configuration when the pressure is greater than a second threshold pressure.

As one example, the rate of canister loading is indicated via a rate of change in temperature of the fuel vapor canister. It may be indicated that the variable orifice valve is functioning as desired, in other words, is not degraded, where degraded refers to the variable orifice valve being one of stuck in the high-flow configuration or the low-flow configuration, when the rate of loading of the canister is within a threshold difference of an expected canister loading rate during the actively manipulating the pressure.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
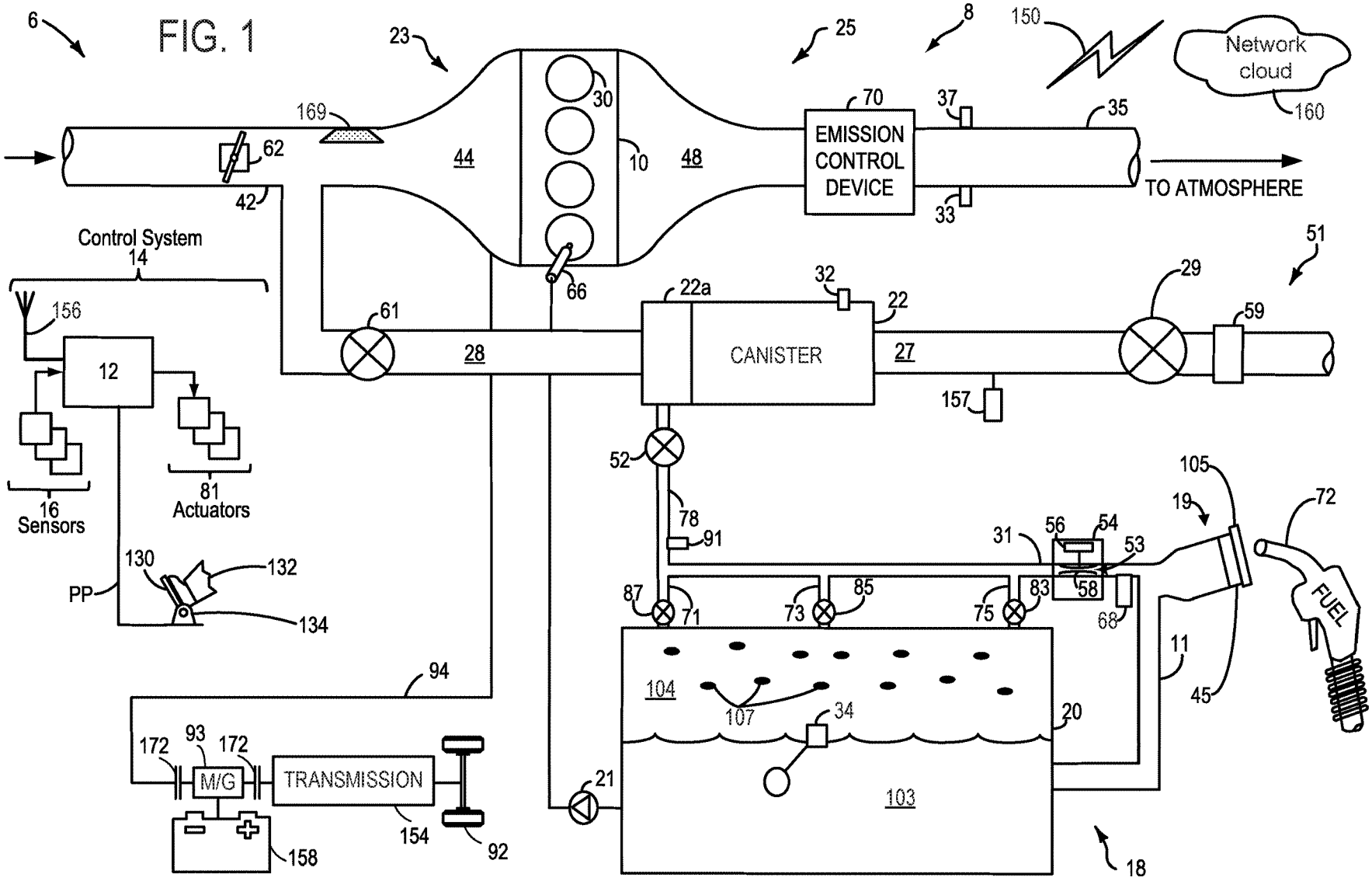
FIG. 1 shows a schematic depiction of a vehicle system including a variable orifice valve in a fuel vapor recovery line.
Figure 2:
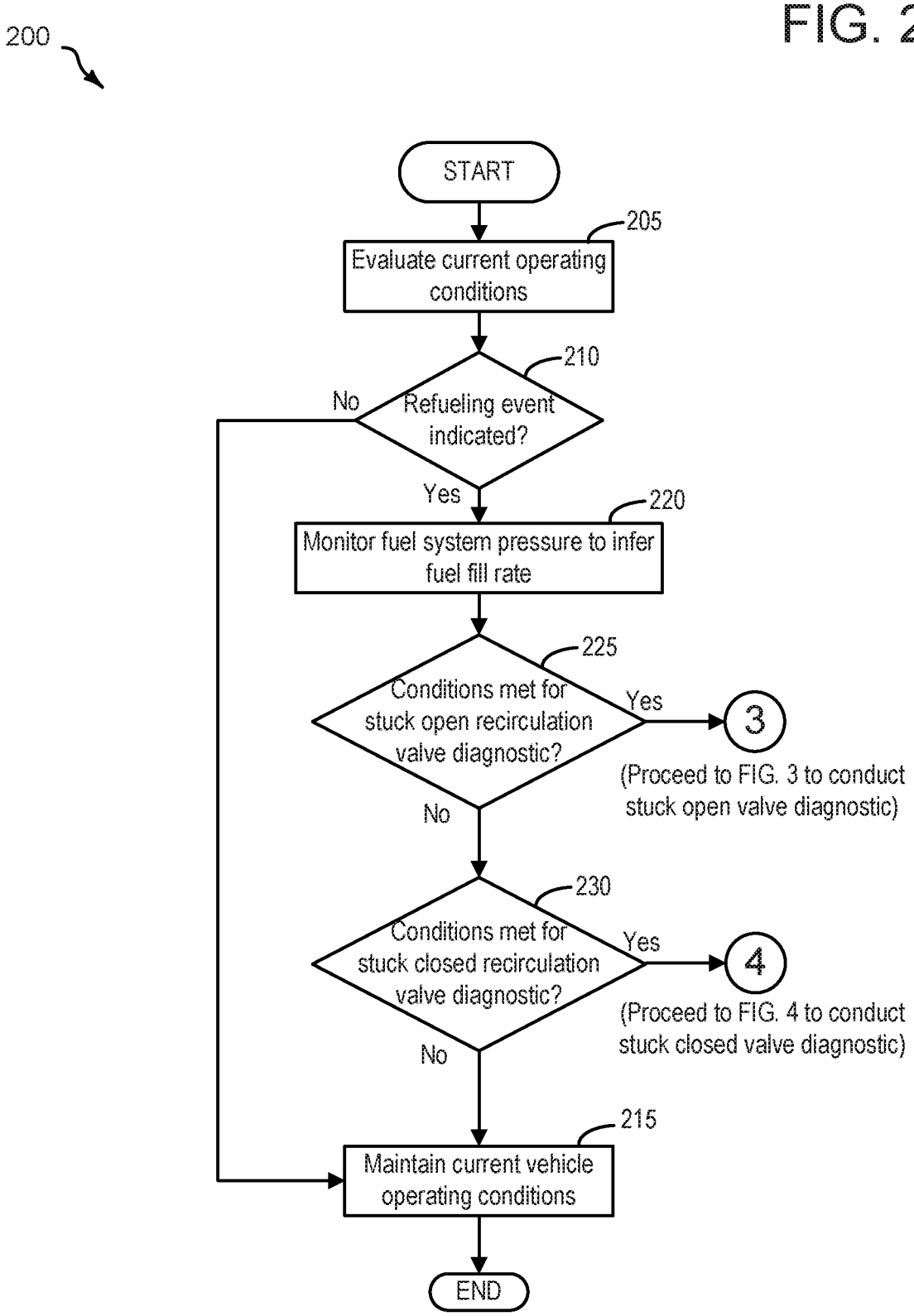
FIG. 2 depicts a flowchart for a high-level example method for selecting whether to conduct a diagnostic to determine whether the variable orifice valve in a fuel vapor recovery line is stuck open, or to conduct a diagnostic to determine whether the variable orifice valve is stuck closed.
Figure 3:
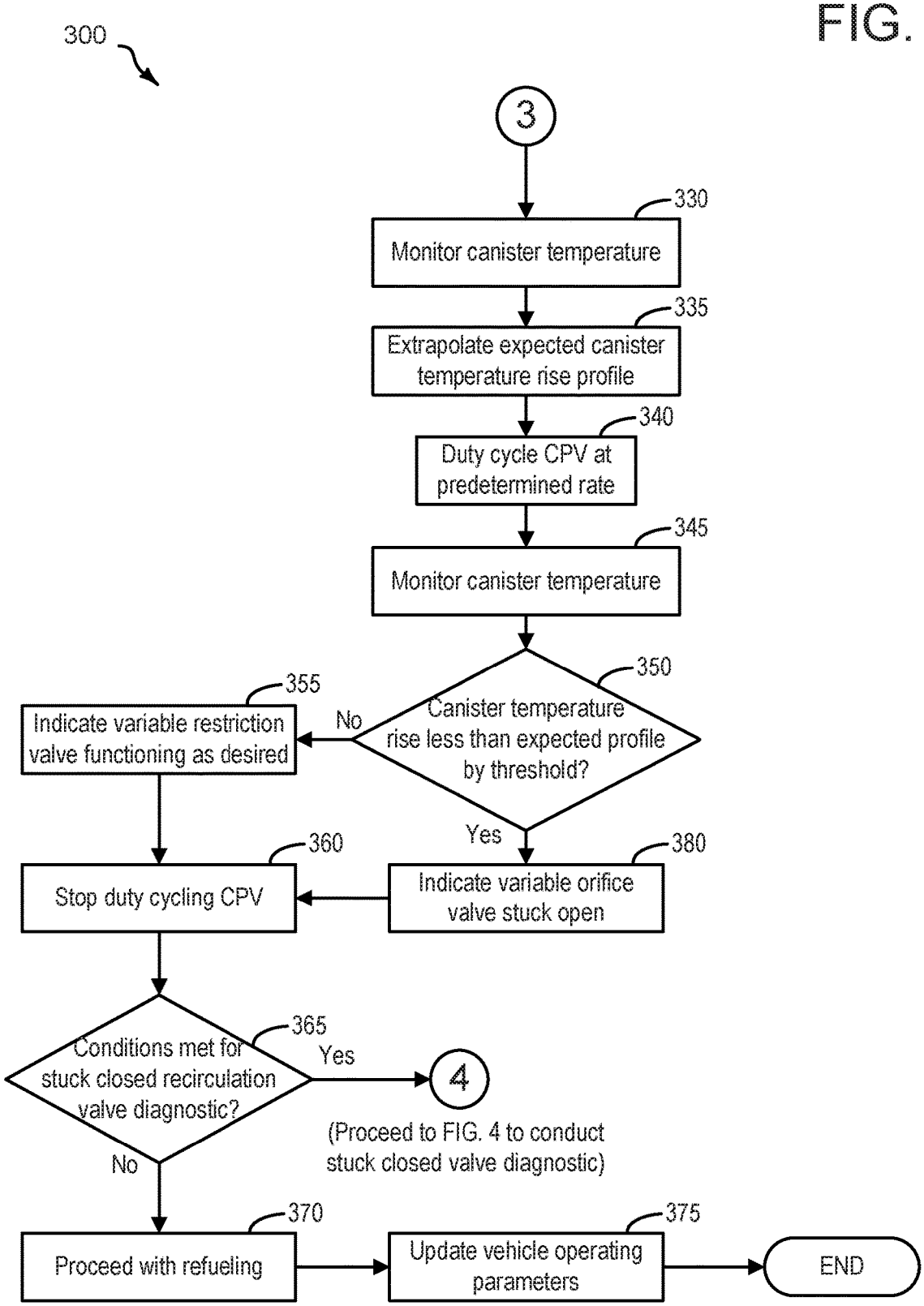
FIG. 3 depicts a flowchart for a high-level example method for conducting the diagnostic to determine whether a variable orifice valve in a fuel vapor recovery line is stuck open.
Figure 4:
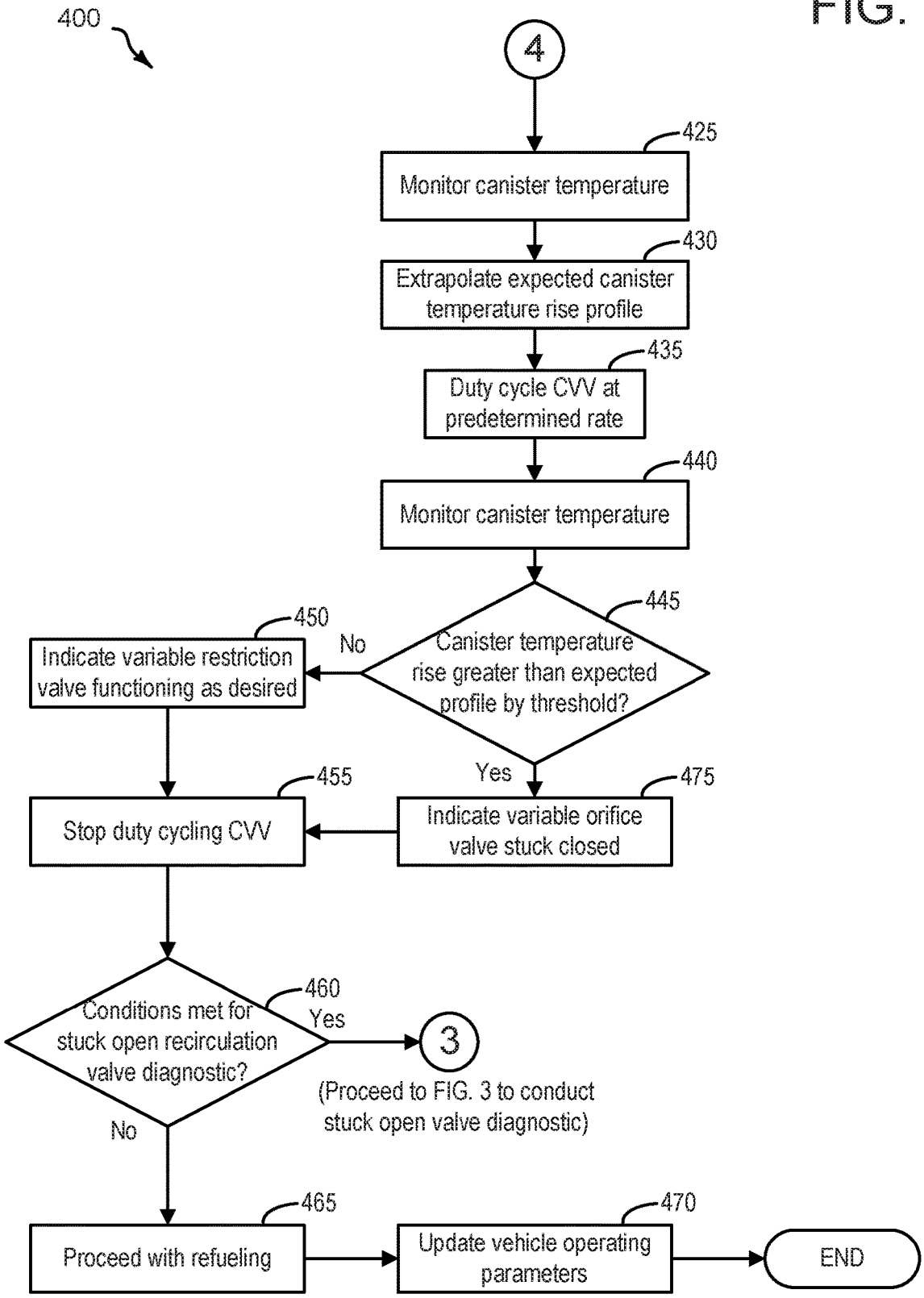
FIG. 4 depicts a flowchart for a high-level example method for conducting the diagnostic to determine whether a variable orifice valve in a fuel vapor recovery line is stuck closed.
Figure 5:
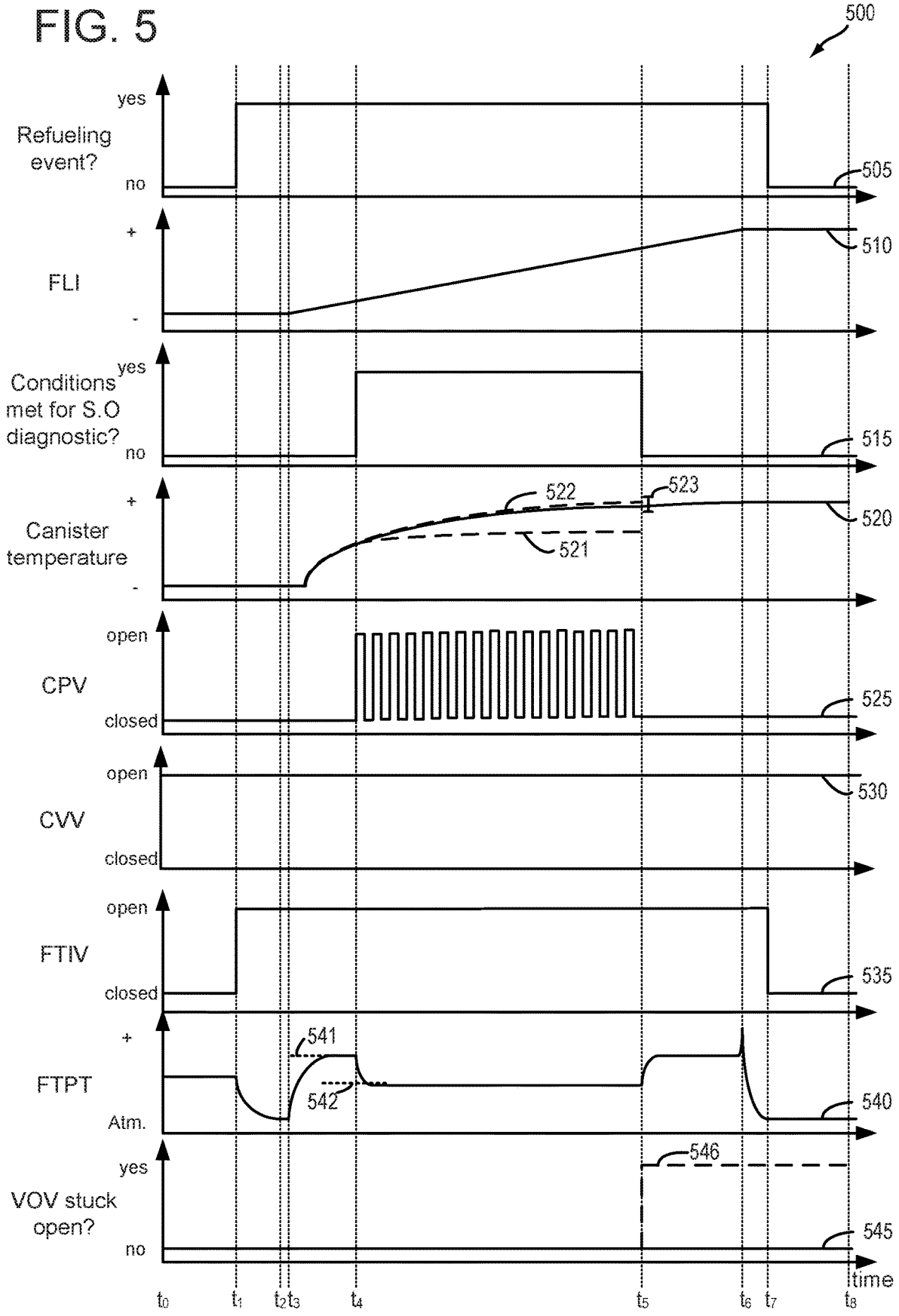
FIG. 5 depicts an example timeline for conducting the diagnostic for determining whether the variable orifice valve is stuck open, according to the method of FIG. 3.
Figure 6:
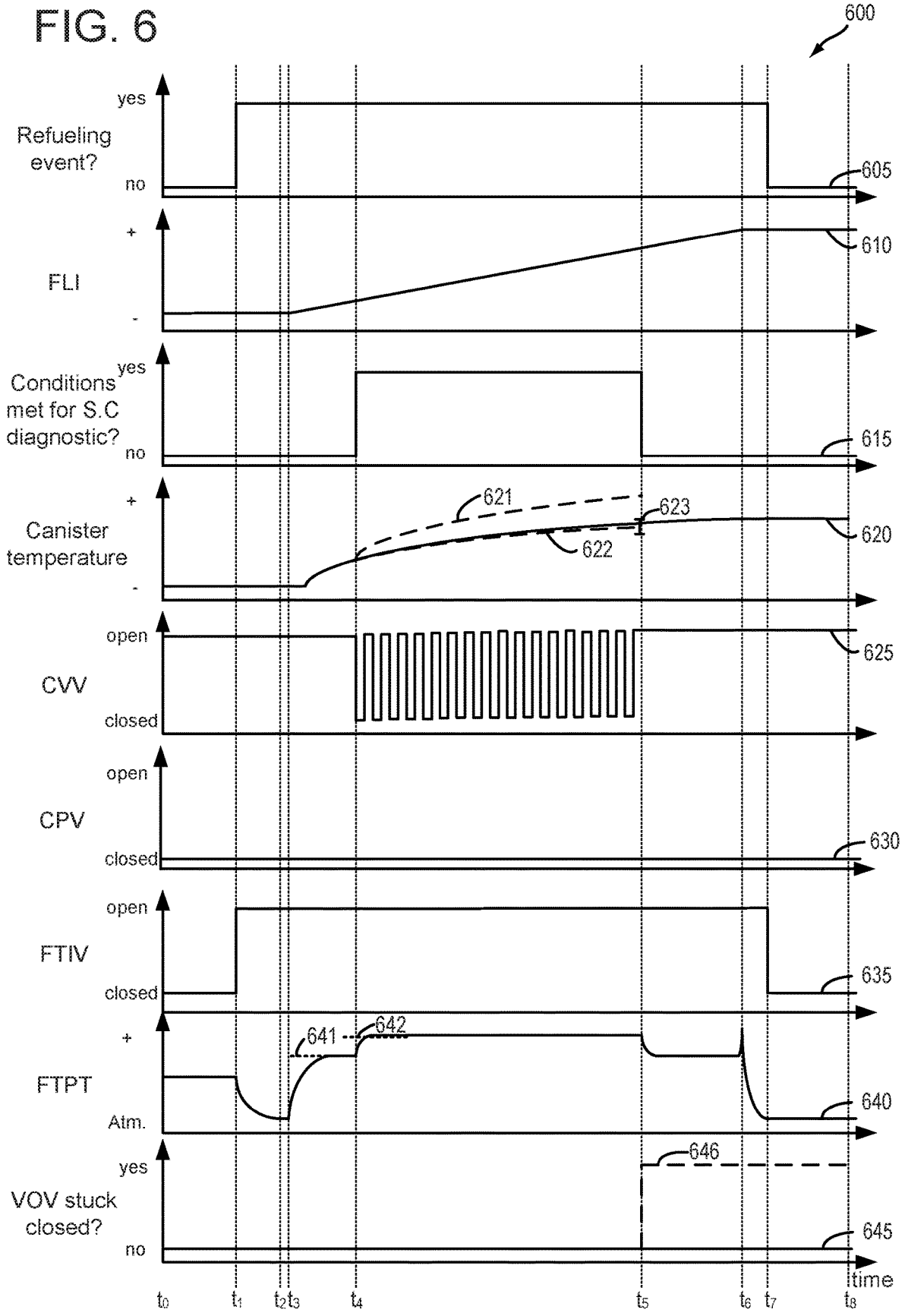
FIG. 6 depicts an example timeline for conducting the diagnostic for determining whether the variable orifice valve is stuck closed, according to the method of FIG. 4.
Figure 7:
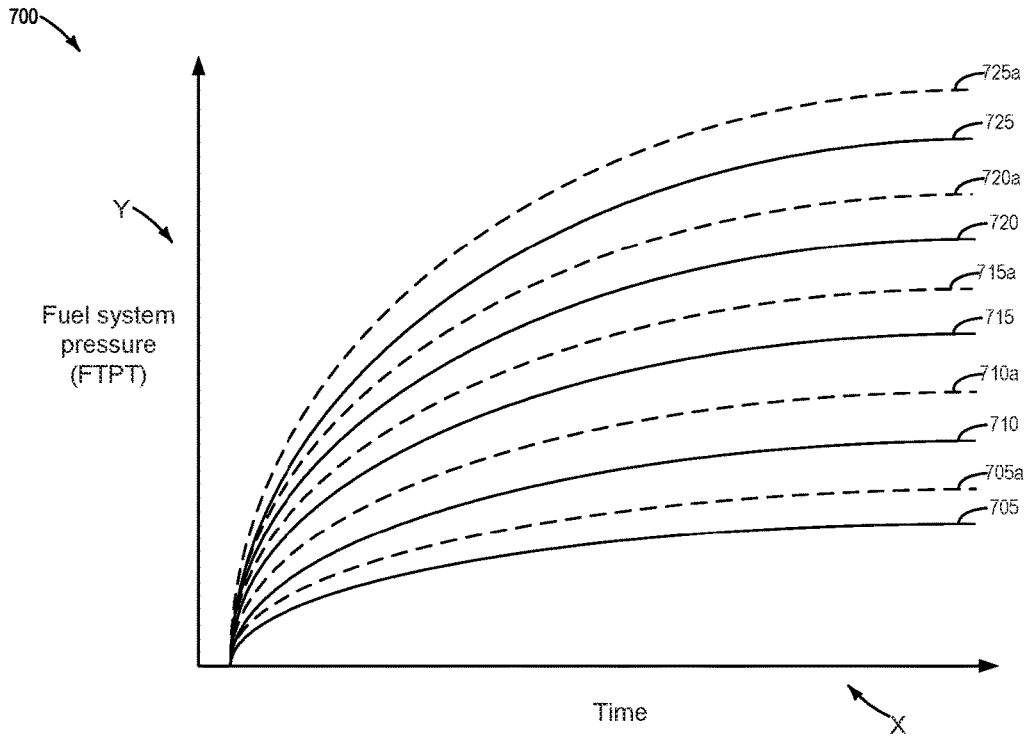
FIG. 7 schematically illustrates fuel system pressure as a function of fuel fill rates for summer fuel and winter fuel.

The following description relates to systems and methods for diagnosing whether a variable orifice valve positioned in a vapor recovery line of a vehicle fuel system, is functioning as desired or expected. In other words, that the valve is not degraded, where degraded refers to the valve being stuck in a high-flow configuration or unable to adopt a low-flow configuration, or being stuck in the low-flow configuration or unable to adopt the high-flow configuration. More specifically, a variable orifice valve that is stuck in a high-flow position (also referred to herein as stuck open), or in other words is unable to close sufficiently to adopt a low-flow position (also referred to herein as stuck closed), may result in undesired evaporative emissions being released to atmosphere via a fuel filler system, whereas a variable orifice valve that is stuck in a low-flow position, or in other words is unable to open sufficiently to adopt a high-flow position, may result in increased loading of a fuel vapor canister configured to trap and store fuel vapors, which may thus result in increased bleed emissions due to fuel vapor breakthrough from the canister. Thus, FIG. 1 illustrates a vehicle with a fuel system selectively fluidically coupled to an evaporative emissions system that includes a fuel vapor canister. The fuel system depicted at FIG. 1 illustrates a fuel vapor recovery line, with a variable orifice valve positioned in the fuel vapor recovery line. Such diagnostics discussed herein rely on refueling events where fuel vapors are routed to the fuel vapor canister for storage. More specifically, the diagnostics include actively manipulating pressure in the fuel system during refueling events in order to bias the variable orifice valve to either the high-flow position, or the low-flow position. It may be understood that the high-flow position includes a position where the variable orifice valve is open to its maximal extent, whereas the low-flow position includes a position where the variable orifice valve is closed to its maximal extent. However, in the low-flow position the variable orifice valve may still allow some amount of flow in some examples. Canister loading rates are then compared (during the actively manipulating the pressure) to expected canister-loading rates assuming the variable orifice valve is not degraded, and if significantly different, then valve degradation may be indicated. FIG. 2 depicts methodology for selecting whether to conduct the diagnostic to indicate whether the variable orifice valve is unable to occupy the low-flow position (in other words, is stuck in the high-flow position), or to conduct the diagnostic to indicate whether the variable orifice valve is unable to occupy the high-flow position (in other words, is stuck in the low-flow position). FIG. 3 depicts methodology for conducting the diagnostic as to whether the variable orifice valve is stuck in the high-flow configuration. FIG. 4 depicts methodology for conducting the diagnostic as to whether the variable orifice valve is stuck in the low-flow configuration. FIG. 5 depicts an example timeline for conducting the diagnostic as to whether the variable orifice valve is stuck in the high-flow configuration, using the methodology of FIG. 3. FIG. 6 depicts an example timeline for conducting the diagnostic as to whether the variable orifice valve is stuck in the low-flow configuration, using the methodology of FIG. 4. Discussed herein, it may be understood that an indication that diagnosing the variable orifice valve being stuck in the low-flow configuration may comprise an indication that the variable orifice valve is unable to adopt the high-flow configuration, whereas diagnosing the variable orifice valve being stuck in the high-flow configuration may comprise an indication that the variable orifice valve is unable to adopt the low-flow configuration. FIG. 7 depicts various pressures in the fuel system as a function of fuel flow rate (in gallons per minute), for both summer and winter fuel.

FIG. 1 shows a schematic depiction of a vehicle system 6. The vehicle system 6 includes an engine system 8 coupled to an emissions control system 51 and a fuel system 18. Emission control system 51 includes a fuel vapor container or canister 22 which may be used to capture and store fuel vapors. In some examples, vehicle system 6 may be a hybrid electric vehicle system, discussed in further detail below.

The engine system 8 may include an engine 10 having a plurality of cylinders 30. The engine 10 includes an engine intake 23 and an engine exhaust 25. The engine intake 23 includes a throttle 62 fluidly coupled to the engine intake manifold 44 via an intake passage 42. The throttle 62 may be in electrical communication with a controller 12, and as such may be an electronically controlled throttle. Said another way, the controller 12, may send signals to an actuator of the throttle 62, for adjusting the position of the throttle 62. The position of the throttle 62 may be adjusted based on one or more of a desired engine torque, desired air/fuel ratio, barometric pressure, etc. Further, in examples where in the intake includes a compressor such as a turbocharger or supercharger, the position of the throttle 62 may be adjusted based on an amount of boost in the intake passage 42.

The engine exhaust 25 includes an exhaust manifold 48 leading to an exhaust passage 35 that routes exhaust gas to the atmosphere. The atmosphere includes the ambient environment surrounding the vehicle, which may have an ambient temperature and pressure (such as barometric pressure). The engine exhaust 25 may include one or more emission control devices 70, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

The vehicle system 6 may be controlled by controller 12 and/or input from a vehicle operator 132 via an input device 130. The input device 130 may comprise an accelerator pedal and/or a brake pedal. A position sensor 134 may be coupled to the input device 130, for measuring a position of the input device 130, and outputting a pedal position (PP) signal to the controller 12. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130. In response to changes in the desired engine torque as determined based on changes in the position of the input device 130, the controller 12 may adjust the position of throttle 62, and/or injectors of engine 10 to achieve the desired engine torque while maintaining a desired air/fuel ratio.

Fuel system 18 may include a fuel tank 20 coupled to a fuel pump system 21. The fuel pump system 21 may include one or more pumps for pressurizing fuel delivered to the injectors of engine 10, such as the example injector 66 shown. While only a single injector 66 is shown, additional injectors are provided for each cylinder. It will be appreciated that fuel system 18 may be a return-less fuel system, a return fuel system, or various other types of fuel system. Fuel tank 20 may hold a plurality of fuel blends, including fuel with a range of alcohol concentrations, such as various gasoline-ethanol blends, including E10, E85, gasoline, etc., and combinations thereof. A fuel level sensor 34 located in fuel tank 20 may provide an indication of the fuel level ("Fuel Level Input") to controller 12. As depicted, fuel level sensor 34 may comprise a float connected to a variable resistor. Alternatively, other types of fuel level sensors may be used. Thus, during a refueling event, outputs from the fuel level sensor 34 may be used to estimate a mass flow rate of fuel being added to the tank 20.

Fuel tank 20 may be partially filled with liquid fuel 103, but a portion of the liquid fuel 103 may evaporate over time, producing fuel vapors 107 in an upper dome portion 104 of the tank 20. The amount of fuel vapors 107 produced may depend upon one or more of the ambient temperature, fuel level, and positions of valves 83, 85, and 87. For example, an amount of fuel vapors 107 in the fuel tank 20 may increase with increasing ambient temperatures, as warmer temperatures may result in increased evaporation of fuel 103 in the fuel tank 20.

A fuel tank pressure sensor (FTPT) 91 may be physically coupled to the fuel tank 20 for measuring and/or estimating the pressure in the fuel tank 20. Specifically, FTPT 91 may be in electrical communication with controller 12, where outputs from the FTPT 91 may be used to estimate a pressure in the fuel tank 20. Further, an amount of fuel vapors in the fuel tank 20 may be estimated based on the pressure in the fuel tank 20 and/or the fuel level in the fuel tank 20 as estimated based on outputs from fuel level sensor 34. In still further examples, outputs from the FTPT 91 may be used to estimate a fuel flow rate into the fuel tank 20. Thus, based on changes in the pressure as estimated based on outputs from the FTPT 91, a mass flow rate of fuel flowing into the tank 20 during a refueling event may be estimated. Specifically, during a refueling event, where fuel is added to the tank 20, the fuel pressure in the tank 20 may increase. As such, a mass flow rate of fuel flowing into the tank 20 may be inferred from changes in the fuel pressure in the tank 20, where the mass flow rate may increase with increasing rates of change in the fuel tank pressure. In the example shown in FIG. 1, the FTPT 91 may be positioned between the fuel tank 20 and the canister 22. However in other examples, the FTPT may be coupled directly to the fuel tank 20. In still further examples the FTPT may be coupled directly to the canister 22.

Vapors generated in fuel system 18 may be routed to the evaporative emissions control system (EVAP) 51 which includes fuel vapor canister 22 via vapor storage line 78, before being purged to the engine intake 23. Vapor storage line 78 may be coupled to fuel tank 20 via one or more conduits and may include one or more valves for isolating the fuel tank during certain conditions. For example, vapor storage line 78 may be coupled on a first end to fuel tank 20 via one or more or a combination of conduits 71, 73, and 75. Further, the vapor storage line 78 may be coupled on an opposite second end to the canister 22, specifically buffer 22*a*, for providing fluidic communication between the fuel tank 20 and the canister 22.

In some examples, the flow of air and vapors between fuel tank 20 and canister 22 may be regulated by a fuel tank isolation valve 52 (FTIV). Thus, FTIV 52 may control venting of fuel tank 20 to the canister 22. FTIV 52 may be a normally closed valve, that when opened, allows for the venting of fuel vapors from fuel tank 20 to canister 22. During a refueling event, the FTIV may adjusted to a more open position to mitigate buildup of excess fuel vapor pressure in the fuel tank 20. Fuel vapors stored in the canister 22, may then be vented to atmosphere, or purged to engine intake system 23 via canister purge valve 61 positioned in a purge line 28. Specifically, during a purging operation, a canister vent valve (CVV) 29 and the CPV 61 may be opened to allow fresh, ambient air to flow through the canister 22. Fuel vapors in the canister may be desorbed as fresh air flows through the canister, and the desorbed fuel vapors may be purged to the intake manifold 44 due to the vacuum generated in the intake manifold 44 during engine operation. Flow of air and vapors between canister 22 and the atmosphere may be regulated by the canister vent valve (CVV) 29, which may be positioned within vent line 27.

Emissions control system 51 may include fuel vapor canister 22. Canister 22 may be filled with an appropriate adsorbent, and may be configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 51 may further include canister ventilation path or vent line 27 which may provide fluidic communication between canister 22 and the atmosphere. Vent line 27 may be coupled on a first end to the canister 22, and may be open to the atmosphere on an opposite second end. CVV 29 may be positioned within the vent line 27, and may be adjusted to a closed position to fluidically seal the canister 22 from the atmosphere. However, during certain engine operating conditions, such as during purging operations, the CVV 29 may be opened to allow fresh, ambient air through the vent line 27 and into the canister, to increase fuel vapor desorption in the canister 22. In other examples, the CVV 29 may be opened during fuel vapor storing operations (for example, during fuel tank refueling and while the engine is not running) so that air, stripped of fuel vapor after having passed through the canister 22, can be pushed out to the atmosphere.

Canister 22 may include a buffer 22*a* (or buffer region), each of the canister and the buffer comprising the adsorbent. As shown, the volume of buffer 22*a* may be smaller than (e.g., a fraction of) the volume of canister 22. The adsorbent in the buffer 22*a* may be same as, or different from, the adsorbent in the canister (e.g., both may include charcoal). Buffer 22*a* may be positioned within canister 22 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Fuel vapor levels in the canister 22 may also be referred to as an amount of canister loading. Thus, canister loading increases with increasing level of fuel vapors stored in the canister 22. Canister loading may be estimated based on outputs from one or more sensors. In the example of FIG. 1, a temperature sensor 32 may be coupled to the canister 22 for measuring an amount fuel vapor levels in the canister 22. Specifically, outputs from the sensor 32 corresponding to a temperature in the canister 22 may be used to infer an amount of fuel vapors stored in the canister 22. Increases in fuel vapors levels in the canister 22 may cause increases in the temperature of the canister 22, and as such a relationship may be established between canister temperatures and canister loading. In some examples, vent line 27 may include an air filter 59 disposed therein, upstream of canister 22.

A hydrocarbon sensor 157 may be positioned in the vent line 27 for measuring an amount of undesired evaporative emissions exiting the vent line 27 to the atmosphere. Such undesired evaporative emissions may be referred to as bleed-through emissions. Sensor 157 may be in electrical communication with controller 12, and outputs from the sensor 157 may be used by the controller 12 to estimate an amount of bleed-through emissions escaping to the atmosphere from the canister 22 via the vent line 27.

In some examples, an air intake system hydrocarbon trap (AIS HC) 169 may be placed in the intake manifold of engine 10 to adsorb fuel vapors emanating from unburned fuel in the intake manifold, puddled fuel from leaky injectors and/or fuel vapors in crankcase ventilation emissions during engine-off periods. The AIS HC may include a stack of consecutively layered polymeric sheets impregnated with HC vapor adsorption/desorption material. Alternately, the adsorption/desorption material may be filled in the area between the layers of polymeric sheets. The adsorption/desorption material may include one or more of carbon, activated carbon, zeolites, or any other HC adsorbing/desorbing materials. When the engine is operational causing an intake manifold vacuum and a resulting airflow across the AIS HC, the trapped vapors are passively desorbed from the AIS HC and combusted in the engine. Thus, during engine operation, intake fuel vapors are stored and desorbed from AIS HC 169. In addition, fuel vapors stored during an engine shutdown can also be desorbed from the AIS HC during engine operation. In this way, AIS HC 169 may be continually loaded and purged, and the trap may reduce evaporative emissions from the intake passage even when engine 10 is shut down.

Fuel system 18 and/or EVAP system 51 may be operated by controller 12 in a plurality of modes by selective adjustment of the various valves and solenoids. One or more of valves 29, 52, and 61 may be normally closed valves. For example, the fuel system may be operated in a fuel vapor storage mode (e.g., during a fuel tank refueling operation and with the engine not running), wherein the controller 12 may open isolation valve 52 while closing canister purge valve (CPV) 61 to direct refueling vapors into canister 22 while preventing fuel vapors from being directed into the intake manifold and/or to the atmosphere.

As another example, the fuel system 18 and/or EVAP system 51 may be operated in a refueling mode (e.g., when fuel tank refueling is requested by a vehicle operator), wherein the controller 12 may open isolation valve 52, while maintaining canister purge valve 61 closed, to depressurize the fuel tank before allowing fuel to be added therein. As such, isolation valve 52 may be kept open during the refueling operation to allow refueling vapors to be stored in the canister. After refueling is completed, the isolation valve may be closed.

As yet another example, the fuel system 18 and/or EVAP system 51 may be operated in a canister purging mode (e.g., after an emission control device light-off temperature has been attained and with the engine running), wherein the controller 12 may open canister purge valve 61 and CVV 29 while closing isolation valve 52. Herein, the vacuum generated by the intake manifold of the operating engine may be used to draw fresh air through vent line 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold.

Based on one or more of the estimated fuel vapor levels in the canister 22, vacuum level in the intake manifold, and a desired purge flow rate, the controller 12, may adjust the position of valves 61 and 29 and 52. Thus, in some examples valves 61, 29 and 52 may be actively controlled valves, and may each be coupled to an actuator (e.g., electromechanical, pneumatic, hydraulic, etc.), where each actuator may receive signals from the controller 12 to adjust the position of its respective valve. However, in other examples, the valves may not be actively controlled, and instead may be passively controlled valves, where the position of the valves may change in response to changes in pressure, temperature, etc., such a wax thermostatic valve.

In examples where the valves 61, 29, and 52 are actively controlled, the valves 61, 29, and 52 may be binary valves, and the position of the valves may be adjusted between a fully closed first position and a fully open second position. However in other examples, the valves 61, 29, and 52 may be continuously variable valves, and may be adjusted to any position between the fully closed first position and fully open second position. Further, the actuators may be in electrical communication with the controller 12, so that electrical signals may be sent between the controller 12 and the actuators. Specifically, the controller may send signals to the actuators to adjust a position of the valves 61, 29, and 52 based on one or more of fuel vapor levels in the canister 22, pressure in the fuel tank 20, fuel level in the fuel tank 20, vacuum level in the intake manifold 44, etc. In some examples, the controller 12 may send signals to the actuators to open one or more of valves 61 and 29, and therefore purge the canister 22, in response to fuel vapor levels in the canister 22 exceeding a threshold. In examples where valves 61, 29 and 52 are solenoid valves, operation of the valves may be regulated by adjusting a driving signal (or pulse width) of the dedicated solenoid.

The fuel tank 20 may include one or more vent valves, which may be deposed in conduits 71, 73, or 75. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 71 may include a first grade vent valve (GVV) 87, conduit 73 may include a fill limit venting valve (FLVV) 85, and conduit 75 may include a second grade vent valve (GVV) 83.

The fuel system 18 may further include a fuel vapor recirculation tube or line 31 (also referred to herein as a fuel vapor recovery line), which may be coupled to the fuel tank 20, and to a fuel fill inlet (also referred to herein as fuel fill system) 19. Specifically, the fuel vapor recirculation line 31, may be coupled to the fuel tank 20, via one or more of conduits 71, 73, and/or 75.

The fuel vapor recirculation line 31 and/or the fuel vapor storage line 78 may be configured to hold a percentage of total fuel vapor generated during a refueling event. For example, the vapor recirculation line 31 and/or fuel vapor storage line 78 may in some examples be configured to hold approximately 20% of the total fuel vapor generated during a refueling event. However, in other examples, the recirculation line 31 and/or storage line 78 may be configured to hold more or less than 20% of the total fuel vapors generated in the fuel tank 20. By effectively increasing the vapor dome volume of the fuel tank 20, the recirculation line 31 may limit the rate of flow of fuel vapors 107 to the fuel vapor canister 22. Depending on the configuration of the fuel dispenser, a portion of the fuel vapor held within the recirculation line 31 may be returned to the fuel dispenser.

Recirculation line 31 may include a variable orifice valve 54. Variable orifice valve 54 may also be referred to herein as continuously variable orifice recirculation valve 54. The variable orifice valve 54 may include a flow restriction 58, which may be a diaphragm, ball, plunger, etc., which restricts flow through the valve 54. Thus, an orifice 53 may be formed by the flow restriction 58, where the size of the orifice 53 may be adjusted by adjusting the flow restriction 58. Specifically, adjusting the flow restriction 58 to a more open position may increase the size of the orifice 53, and thereby may increase an amount of gasses flowing through the valve 54. Conversely, adjusting the flow restriction 58 to a more closed position may decrease the size of the orifice 53, thereby decreasing an amount of gasses flowing through the valve 54. In the description herein, closing the valve 54 comprises adjusting the flow restriction 58 to a more closed position (where a low-flow configuration comprises the maximal extent the valve can close). Similarly, opening the valve 54 comprises adjusting the flow restriction 58 to a more open position (where a high-flow configuration comprises the maximal extent the valve can open). In some examples, the valve 54 may include only one orifice. However, in other examples, the valve 54 may include more than one orifice, where the size of each orifice may be adjustable.

A position of the flow restriction 58 may be adjusted by an actuator 56 of valve 54. The actuator may in some examples be an electromechanical actuator. In other embodiments, the actuator may be hydraulic or pneumatic. In one example, the actuator is spring actuated, in response to pressure in the vapor recovery line. For example, a spring comprising the actuator 56 may hold the orifice 53 in a low-flow position when pressure in the vapor recovery line is below a first threshold pressure. Then, increasing pressure in the vapor recovery line may act on the spring, for example compressing the spring, which may thus result in the orifice opening further, the extent of opening based on the amount of pressure in the vapor recovery line. When pressure in the vapor recovery line is great enough, for example above a second threshold pressure, the spring may be compressed such that orifice 53 may occupy a high-flow position. Thus, discussed herein, a diagnostic for a stuck-closed variable orifice valve 54 may comprise a diagnostic as to whether the variable orifice valve is stuck in the low-flow position, or substantially in the low-flow position (e.g. not different than the low-flow position by more than a 5% difference, 10% difference, 20% difference, etc.). In one example, rather than specifically indicating the variable orifice valve is stuck in the low-flow position, the diagnostic may indicate the variable orifice valve is not capable of adopting the high-flow position.

Alternatively, a diagnostic for a stuck-open variable orifice valve 54 may comprise a diagnostic as to whether the variable orifice valve is stuck in the high-flow position, or substantially in the high-flow position (e.g. not different than the high-flow position by more than a 5% difference, 10% difference, 20% difference, etc.). In one example, rather than specifically indicating the variable orifice valve is stuck in the high-flow position, the diagnostic may indicate the variable orifice valve is not capable of adopting the low-flow position. It may be understood that under conditions where the valve 54 is spring-actuated, the valve is passively actuated in response to pressure in the vapor recovery line 31.

In some examples the actuator 56 may be included within the valve 54. However, in other examples, the actuator 56 may be external to the valve 54, but may be physically coupled to the valve 54. The actuator 56 is mechanically coupled to the flow restriction 58, for adjusting the position of the flow restriction 58, and therefore the size of the orifice 53. Thus, in an example where the actuator 56 comprises a spring actuator, the spring is mechanically coupled to the flow restriction for adjusting the size of the orifice 53. In an example where the actuator 56 comprises an electromechanical actuator 56, the actuator 56 may be an electric motor comprising a solenoid and armature assembly for generating rotational motion from electrical input.

Thus, in some examples the actuator 56 may be in electrical communication with the controller 12. Based on signals received from the controller 12, the actuator 56 may adjust the position of the flow restriction 58 to adjust the size of the orifice 53. Said another way, the controller 12 may send signals to the actuator 56 to adjust the size of the orifice 53 by adjusting the position of the flow restriction 58. More specifically, a pulse width modulated (PWM) signal may be communicated to the actuator 56 by the controller 12. In one example, the PWM signal may be at a frequency of 10 Hz. In another example, the actuator 56 may receive a PWM signal of 20 Hz. In yet another examples, the solenoid of the actuator 56 may be actuated synchronously.

By adjusting the size of the orifice 53, an amount of air and/or fuel vapors flowing through recirculation line 31 may be adjusted. However, as discussed above, there may be circumstances where the variable orifice valve becomes stuck at the low-flow or high-flow position. It is desirable to diagnose such conditions of degradation because if the valve becomes stuck in the low-flow position, the canister may be loaded to greater extents during refueling events, which may lead to bleed-through emissions from the canister. Alternatively, if the valve becomes stuck in the high-flow position, release of undesired evaporative emissions via the fuel filler system may result during refueling events. Accordingly, an example method for diagnosing whether the variable orifice valve 54 is stuck in the low-flow position is depicted at FIG. 3. An example method for diagnosing whether the variable orifice valve 54 is stuck in the high-flow position is depicted at FIG. 4. A high-level method for selecting which diagnostic to conduct first at a particular refueling event is depicted at FIG. 2.

In some examples, vapor recirculation line 31 may further include a pressure sensor 68 configured to measure a pressure in the recirculation line 31. Outputs from the sensor 68 may be used by the controller 12 to estimate a pressure in the recirculation line 31. In some examples, based on the outputs from the sensor 68, the controller 12 may send signals to the actuator 56 to adjust the position of the flow restriction 58.

Thus, fuel vapors 107 from fuel tank 20 may be directed through the recirculation line 31 and valve 54, on route to the fuel fill inlet 19. Fuel fill inlet 19 may be configured to receive fuel from a fuel source such as dispensing nozzle 72. During a refueling event, the nozzle 72 may be inserted into the fill inlet 19, and fuel may be dispensed into the fuel tank 20. Thus a refueling event comprises the dispensing of fuel from a fuel source into the fuel tank 20. In some examples, fuel fill inlet 19 may include a fuel cap 105 for sealing off the fuel fill inlet 19 from the atmosphere. However, in other examples, the fuel fill inlet 19 may be a capless design and may not include a fuel cap 105. Fuel filler inlet 19 is coupled to fuel tank 20 via fuel filler pipe or neck 11. As such, fuel dispensed from the nozzle 72, may flow through the filler neck 11 into the tank 20.

Fuel fill inlet 19 may further include refueling lock 45. In some embodiments, refueling lock 45 may be a fuel cap locking mechanism. The refueling lock 45 may be configured to automatically lock the fuel cap 105 in a closed position so that the fuel cap 105 cannot be opened. For example, the fuel cap 105 may remain locked via refueling lock 45 while pressure or vacuum in the fuel tank is greater than a threshold. In response to a refuel request, e.g., a vehicle operator initiated request, the fuel tank 20 may be depressurized and the fuel cap 105 unlocked after the pressure or vacuum in the fuel tank 20 falls below a threshold. The refueling lock 45 may be a latch or clutch, which, when engaged, prevents the removal of the fuel cap 105. The latch or clutch may be electrically locked, for example, by a solenoid, or may be mechanically locked, for example, by a pressure diaphragm.

In some embodiments, refueling lock 45 may be a filler pipe valve located at a mouth of fuel filler pipe 11. In such embodiments, refueling lock 45 may not prevent the removal of fuel cap 105. Rather, refueling lock 45 may prevent the insertion of dispensing nozzle 72 into fuel filler pipe 11. The filler pipe valve may be electrically locked, for example by a solenoid, or mechanically locked, for example by a pressure diaphragm.

In some embodiments, refueling lock 45 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 45 is locked using an electrical mechanism, refueling lock 45 may be unlocked by commands from controller 12, for example, when a fuel tank pressure decreases below a pressure threshold. In embodiments where refueling lock 45 is locked using a mechanical mechanism, refueling lock 45 may be unlocked via a pressure gradient, for example, when a fuel tank pressure decreases to atmospheric pressure.

As discussed, fuel vapors 107 from recirculation line 31, may flow into filler neck 11, and back into fuel tank 20. Thus a portion of fuel vapors 107 in the fuel tank 20, may flow out of the fuel tank into recirculation line 31, through filler neck 11, and back into the fuel tank 20.

Controller 12 may comprise a portion of a control system 14. Control system 14 is shown receiving information from a plurality of sensors 16 (various examples of which are described herein) and sending control signals to a plurality of actuators 81 (various examples of which are described herein). As one example, sensors 16 may include temperature sensor 32, universal exhaust gas oxygen (UEGO) sensor 37, temperature sensor 33, and pressure sensor 68. Other sensors such as pressure, temperature, air/fuel ratio, and composition sensors may be coupled to various locations in the vehicle system 6. As another example, the actuators may include fuel injector 66, throttle 62, FTIV 52, CVV 29, CPV 61, actuator 56 of variable orifice valve 54 (in some examples where the variable orifice valve is electronically actuatable), etc. The controller 12 may be shifted between sleep and wake-up modes for additional energy efficiency. During a sleep mode the controller may save energy by shutting down on-board sensors, actuators, auxiliary components, diagnostics, etc. Essential functions, such as clocks and controller and battery maintenance operations may be maintained on during the sleep mode, but may be operated in a reduced power mode. During the sleep mode, the controller will expend less current/voltage/power than during a wake-up mode. During the wake-up mode, the controller may be operated at full power, and components operated by the controller may be operated as dictated by operating conditions. The controller 12 may receive input data from the various sensors, process the input data, and trigger the actuators in response to the processed input data based on instruction or code programmed therein corresponding to one or more routines. Example control routines are described herein and with regard to FIGS. 2-4.

Vehicle system 6 may be a hybrid vehicle with multiple sources of torque available to one or more vehicle wheels 92. In the example shown, vehicle system 6 may include an electric machine 93. Electric machine 93 may be a motor or a motor/generator. Crankshaft 94 of engine 10 and electric machine 93 are connected via a transmission 154 to vehicle wheels 92 when one or more clutches 172 are engaged. In the depicted example, a first clutch is provided between crankshaft 94 and electric machine 93, and a second clutch is provided between electric machine 93 and transmission 154. Controller 12 may send a signal to an actuator of each clutch 172 to engage or disengage the clutch, so as to connect or disconnect crankshaft 94 from electric machine 93 and the components connected thereto, and/or connect or disconnect electric machine 93 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 93 receives electrical power from a traction battery 158 to provide torque to vehicle wheels 92. Electric machine 93 may also be operated as a generator to provide electrical power to charge traction battery 158, for example during a braking operation.

As will be discussed in further detail below with regard to the methods depicted at FIGS. 2-4, a fuel fill rate during a refueling event may be determined based on a steady state fuel system pressure (as monitored via pressure sensor 91, for example) that builds in the fuel system during such a refueling event. More specifically, there may be two lookup tables stored at the controller that correlate steady state fuel system pressure with fuel fill rate, one lookup table corresponding to summer fuel with a lower reid vapor pressure (RPV) and the other lookup table corresponding to winter fuel with a higher RVP. In other words, summer fuel has a lower RVP than winter fuel, and thus, to accurately determine fuel fill rate during a refueling event, the lookup table corresponding to summer fuel may be utilized during summer months, whereas the lookup table corresponding to winter fuel may be utilized during winter months.

The controller 12 may be coupled to a wireless communication device 156 for direct communication of the vehicle system 6 with a network cloud 160. Network cloud 160 may comprise the internet. Using wireless communication 150 via the wireless communication device 156, the vehicle system 6 may retrieve data regarding current and/or upcoming ambient conditions (such as ambient humidity, temperature, pressure, etc.) from the network cloud 160. In some examples, the wireless communication device 156 may be used to obtain information as to the current date (month), in order to infer whether fuel being added to the fuel tank during a refueling event is likely to be summer fuel or winter fuel. In other examples, if the vehicle is equipped with an onboard navigation device (e.g. GPS), capable of determining current date, then the GPS may additionally or alternatively be relied upon for inferring whether summer or winter fuel is being added to the fuel tank during refueling events.

Turning briefly now to FIG. 7, a graphic illustration 700 is depicted showing the relationship between fuel system pressure during refueling events and fuel fill rate (in gallons per minute, or GPM). Fuel system pressure is depicted on the Y axis, while time is depicted on the X axis. In other words, fuel system pressure is illustrated as a function of time during refueling events, where each individual line corresponds to a different fuel fill rate. Specifically, solid lines depict summer fuel with a lower RVP, while dashed lines depict winter fuel with a higher RVP. Line 705 corresponds to a fuel fill rate of 4 GPM, line 710 corresponds to a fuel fill rate of 6 GPM, line 715 corresponds to a fuel fill rate of 8 GPM, line 720 corresponds to a fuel fill rate of 10 GPM, and line 725 corresponds to a fuel fill rate of 12 GPM. Winter fuel shifts the curves upwards, thus dashed line 705*a* corresponds to a fuel fill rate of 4 GPM, dashed line 710*a* corresponds to a fuel fill rate of 6 GPM, dashed line 715*a* corresponds to a fuel fill rate of 8 GPM, dashed line 720*a* corresponds to a fuel fill rate of 10 GPM, and dashed line 725*a* corresponds to a fuel fill rate of 12 GPM.

Thus, it may be understood that, during refueling events, fuel system pressure may be monitored over time, and steady state fuel system pressure reached during said refueling events may be compared to a particular lookup table (depending on whether the fuel being dispensed is summer fuel or winter fuel), in order to infer fuel fill rate in GPM. As discussed above, the controller may make a determination as to whether the fuel being added is summer or winter fuel via the wireless communication device (e.g. 156) or navigation system (e.g. GPS).

As discussed, the variable orifice valve (e.g. 54) may open to greater extents in response to greater pressures in the vapor recovery line (e.g. 31), and close to greater extents in response to lesser pressures in the vapor recovery line. Such opening/closing may be passive in the case of a spring-actuated valve, as discussed above, or may be under control of the vehicle controller in the case of an electromechanically-actuated valve. Thus, at pressures in the vapor recovery line exceeding the second threshold pressure (e.g. 11-12 GPM), it may be expected that the variable orifice valve is occupying the high-flow position if the valve is not degraded. Alternatively, at pressures in the vapor recovery line below the first threshold pressure (e.g. 4-5 GPM), it may be expected that the variable orifice valve is occupying the low-flow position if the valve is not degraded. Such conditions may allow for diagnosing whether the variable orifice valve is stuck open (stuck in the high-flow position or unable to adopt the low-flow position) or closed (stuck in the low-flow position or unable to adopt the high-flow position), based on a readout such as canister loading amount, for example. More specifically, by actively manipulating pressure in the fuel system during a refueling event such that fuel system pressure exceeds the second threshold pressure, then there may be an expected canister loading rate assuming the variable orifice valve is not degraded. However, if a monitored canister loading rate is significantly higher than the expected canister loading rate, then it may be inferred that the variable orifice valve is stuck closed (stuck in the low-flow state or unable to adopt the high-flow state). Alternatively, by actively manipulating pressure in the fuel system during a refueling event such that fuel system pressure is below the first threshold pressure, there may be a different expected canister loading rate assuming the variable orifice valve is not degraded. However, if a monitored canister loading rate is significantly lower than the excepted canister loading rate, then it may be inferred that the variable orifice valve is stuck open (stuck in the high-flow state or unable to adopt the low-flow state). Actively manipulating the pressure in the fuel system during refueling events may enable such diagnostics to be conducted regularly, as it may otherwise be unlikely that a vehicle may encounter such dramatic differences in refueling rates, to enable the diagnostic described without actively manipulating pressure in the fuel system. In other words, most fuel filling stations dispense at a rate roughly corresponding to 8-10 GPM, and very low (4-5 GPM) or very high (>12 GPM) dispense rates are rare. By manipulating pressure in the fuel system, the variable orifice valve may be biased to adopt known configurations, and by monitoring canister loading under such conditions, indications as to whether the variable orifice valve is degraded, may be determined.

Accordingly, the systems and methodology described herein and with regard to FIGS. 1-4, respectively, relate to actively manipulating pressure in the fuel system and evaporative emissions system during refueling events in order to mimic/simulate conditions of high dispense rates or low dispense rates. In this way, it may be determined as to whether the variable orifice valve is stuck in a high-flow configuration or a low-flow configuration by monitoring a rate of canister loading, as will be discussed in further detail below. By diagnosing such conditions and taking mitigating action in response to such conditions, release of undesired evaporative emissions (e.g. fuel vapors) to atmosphere may be reduced.

Thus, the system discussed above at FIG. 1 may enable a system for a vehicle comprising a fuel system including a fuel tank and a fuel vapor recovery line for recirculating fuel vapors back to the fuel tank. The system may include a variable orifice valve positioned in the fuel vapor recovery line. The system may include an evaporative emissions system fluidically coupled to the fuel system, the evaporative emissions system including a fuel vapor storage canister. The system may include a canister purge valve positioned in a purge line selectively fluidically coupling the fuel vapor storage canister to an intake of an engine. The system may include a canister vent valve positioned in a vent line selectively fluidically coupling the fuel vapor storage canister to atmosphere. The system may further include a controller with computer readable instructions stored on non-transitory memory that, when executed, cause the controller to, during a refueling event, actively manipulate pressure in the fuel system via duty cycling either the canister purge valve or the canister vent valve, and indicate whether the variable orifice valve is degraded based on a rate at which the fuel vapor storage canister is loaded with fuel vapors during the actively manipulating pressure in the fuel system.

In such a system, the controller may store further instructions to indicate that the variable orifice valve is stuck in a high-flow configuration in response to the rate at which the fuel vapor storage canister is loaded with fuel vapors during duty cycling the canister purge valve being less than a first expected canister loading rate by more than a first threshold difference.

In such a system, the controller may store further instructions to indicate that the variable orifice valve is stuck in a low-flow configuration in response to the rate at which the fuel vapor storage canister is loaded with fuel vapors during duty cycling the canister vent valve being greater than a second expected canister loading rate by more than a second threshold difference.

Turning now to FIG. 2, a flow chart for a high-level example method 200 is depicted for, at a refueling event, determining whether to initiate a diagnostic pertaining to whether the variable orifice valve is unable to adopt the low-flow configuration, whether to initiate a diagnostic pertaining to whether the variable orifice valve is unable to adopt the high-flow configuration, or whether to proceed with refueling without conducting any diagnostic, is shown. In this way, a variable orifice valve in a fuel vapor recovery line in a vehicle fuel system may be diagnosed as to whether it is stuck in a high-flow or low-flow configuration. By conducting such diagnostics, bleed-through emissions, either break-through from the canister or break-through from the fuel filler inlet, may be reduced or avoided. Canister function and lifetime may be improved/extended.

Method 200 will be described with reference to the systems described herein and shown in FIG. 1, though it should be understood that similar methods may be applied to other systems without departing from the scope of this disclosure. Method 200 may be carried out by a controller, such as controller 12 in FIG. 1, and may be stored at the controller as executable instructions in non-transitory memory. Instructions for carrying out method 200 and the rest of the methods included herein may be executed by the controller based on instructions stored on a memory of the controller and in conjunction with signals received from sensors of the engine system, such as the sensors described above with reference to FIG. 1. The controller may employ fuel system and evaporative emissions system actuators, such as canister purge valve (CPV) (e.g. 61), canister vent valve (CVV) (e.g. 29), FTIV (e.g. 52), variable orifice valve actuator (e.g. 56) (where applicable), etc., to alter states of devices in the physical world according to the methods depicted below.

Method 200 begins at 205 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 210, method 200 may include indicating whether a refueling event is indicated. A refueling event may be indicated in response to a request from a vehicle operator to initiate refueling, for example in response to the vehicle operator pressing an appropriate button on the dash, etc. A refueling event may be additionally or alternatively indicated responsive to a fuel cap (e.g. 105) being indicated to be removed from a fuel filler inlet (e.g. 19), an indication that a refueling lock (e.g. 45) has been unlocked, etc. A refueling event may be additionally or alternatively indicated in response to an indication that fuel level in the fuel tank is increasing consistently (e.g. linearly) over a period of time (e.g. 5-10 seconds), as monitored for example via a fuel level sensor (e.g. 34).

If, at 210, a refueling event is not indicated, method 200 may proceed to 215. At 215, method 200 may include maintaining current vehicle operating conditions. For example, if the vehicle is in operation being propelled via the engine, or at least in part via the motor (e.g. 93), then such vehicle operation conditions may be maintained. Method 200 may then end.

Returning to 210, in response to a refueling event being indicated, method 200 may proceed to 220. While not explicitly illustrated, it may be understood that for vehicles equipped with an FTIV (e.g. 52), in response to the request for refueling, the FTIV may be commanded open via the controller and refueling may be enabled to commence (e.g. the refueling lock may be commanded open) in response to pressure in the fuel system being within a threshold of atmospheric pressure (e.g. not different than atmospheric pressure by greater than a 5% difference).

At 220, method 200 may include monitoring fuel system pressure to infer a fuel fill rate, for example in GPM. As discussed above, such an inference may be made via the controller monitoring a steady state pressure in the fuel system during the refueling event, and querying an appropriate lookup table stored at the controller to determine the fuel fill rate in GPM. The appropriate lookup table (e.g. a lookup table corresponding to summer fuel or a lookup table corresponding to winter fuel) may be determined via the controller based on whether it is likely that summer fuel is being added to the fuel tank or if winter fuel is being added to the fuel tank. Such a determination may be based on the controller determining the date, for example via wireless communication with internet or via an onboard navigation device (e.g. GPS), etc. In other words, if the month is July, then the controller may infer that the fuel being added to the fuel tank comprises summer fuel.

Proceeding to 225, method 200 may include indicating whether conditions are met for conducting the diagnostic as to whether the variable orifice valve (e.g. 54) is stuck open, or in other words, stuck in the high-flow position or unable to adopt the low-flow configuration. Conditions being met at 225 may include an indication that canister purging operations are not occurring as frequently as expected or predicted as a function of refueling events, diurnal temperature fluctuations, engine run-time, etc. More specifically, canister purging operations where the canister is cleaned of stored fuel vapors may be requested based on estimated canister loading state. Such an estimate may be provided via one or more canister temperature sensor(s) (e.g. 32). If the controller is requesting/scheduling canister purging events less frequently than would be expected, then the lower amount of canister loading may be due to the variable orifice valve being stuck in the high-flow configuration. Another possibility for such a lower rate of canister loading may be due to a source of undesired evaporative emissions stemming from the vapor storage line (e.g. 78) and/or vapor recovery line (e.g. 31), fuel tank, etc. Thus, conditions being met for conducting the diagnostic for the variable orifice valve being stuck in the high-flow position may further include an indication that the vapor storage line, vapor recovery line, fuel system and evaporative emissions system are free from undesired evaporative emissions.

Tests for the presence or absence of undesired evaporative emissions stemming from the fuel system and/or evaporative emissions system may include communicating a negative pressure with respect to atmospheric pressure on the fuel system and evaporative emissions system with the fuel system and evaporative emissions system otherwise sealed from atmosphere. The negative pressure may be applied via communicating engine intake manifold vacuum to the fuel system and evaporative emissions system. In other words, with the engine operating to combust air and fuel, intake manifold vacuum may be applied on the fuel system and evaporative emissions system via commanding open the CPV (e.g. 61), commanding open the FTIV (e.g. 52), and commanding closed the CVV (e.g. 29). In response to a threshold negative pressure being reached, as monitored via the FTPT (e.g. 91), the fuel system and evaporative emissions system may be sealed from engine intake via commanding closed the CPV. A rate of pressure bleed-up may thus be monitored in the sealed fuel system and evaporative emissions system, and compared to an expected rate of pressure bleed-up under circumstances where there is no source of undesired evaporative emissions stemming from the fuel system and evaporative emissions system. If the rate of pressure bleed-up is not different from the expected rate of pressure bleed-up by more than a threshold, then it may be determined that the fuel system and evaporative emissions system are free from undesired evaporative emissions. While the use of engine manifold vacuum for conducting such a diagnostic is discussed, in other examples a pump positioned in the evaporative emissions system may be utilized for applying a negative pressure on the fuel system and evaporative emissions system to conduct such a test for the presence or absence of undesired evaporative emissions, without departing from the scope of this disclosure. In still other examples, a positive pressure may be introduced to the fuel system and evaporative emissions system (for example via a pump as discussed), and in similar fashion, a pressure bleed-down rate may be compared to an expected pressure bleed-down rate in order to infer presence or absence of undesired evaporative emissions.

Conditions being met at 225 may additionally or alternatively include a threshold duration of time elapsing since a prior test diagnostic as to whether the variable orifice valve is stuck in the high-flow position. For example, such diagnostics may be periodically conducted (e.g. once every 10 days, once every 20 days, once every 30 days, etc.) during refueling events, to assess whether the variable orifice valve is degraded.

Conditions being met at 225 may additionally or alternatively include an indication that the fuel fill rate is within a range of a desired fuel fill rate for conducting the diagnostic. For example, if the fuel fill rate is determined to be within 7.5-8.5 GPM, then conditions may be indicated to be met for conducting the diagnostic. Other such ranges are possible, without departing from the scope of this disclosure. For example the range for conditions being met for conducting the diagnostic may be 7-8 GPM, 8-9 GPM, 8-10 GPM, etc.

In response to conditions being indicated to be met for conducting the diagnostic as to whether the variable orifice valve is stuck in the high-flow configuration, method 200 may proceed to FIG. 3, where the methodology of method 300 may be used to assess whether the variable orifice valve is stuck in the high-flow configuration, or in other words, is unable to adopt the low-flow configuration.

Alternatively, if at 225 conditions are not indicated to be met for conducting the diagnostic as to whether the variable orifice valve is stuck in the high-flow position, then method 200 may proceed to 230 where it may be indicated as to whether conditions are met for conducting the diagnostic to determine whether the variable orifice valve is stuck in the low-flow position or in other words is unable to adopt the high-flow configuration, the low-flow position also referred to herein as the stuck closed position. Conditions being met at 230 may include an indication that canister purging operations are occurring more frequently than expected or predicted as a function of refueling events, diurnal temperature fluctuations, engine run time, etc. More specifically, as discussed above, canister purging operations where the canister is cleaned of stored fuel vapors may be requested based on estimated canister loading state. If the controller is requesting/scheduling canister purging events more frequently than would otherwise be expected, then the greater amount of canister loading may be due to the variable orifice valve being stuck in the low-flow configuration. In another example, if the canister is being loaded to greater extents than would be expected for particular refueling events, then the culprit may be that the variable orifice valve is stuck in the low-flow configuration. For example, the canister temperature sensor may be used to infer canister loading state during refueling events, and based on the amount of fuel added to the fuel tank, if the amount of canister loading deviates from (is greater than) an expected amount of canister loading for such refueling events, then the variable orifice valve may be stuck in the low-flow configuration. In still another example, an increase in bleed-through emissions, as monitored for example, via a hydrogen sensor (e.g. 157) positioned in the vent line (e.g. 27), as compared to an expected amount of bleed-through emissions under conditions where the variable orifice valve is not degraded, may be indicative of a variable orifice valve that is stuck in a low-flow configuration. The increase in bleed-emissions may be over a predetermined time frame, for example over 1 day, several days, one or two weeks, etc.

Conditions being met at 230 may additionally or alternatively include a threshold duration of time elapsing since a prior test diagnostic as to whether the variable orifice valve is stuck in the low-flow position. For example, such diagnostics may be periodically conducted (e.g. once every 10 days, once every 20 days, once every 30 days, etc.) during refueling events, to assess whether the variable orifice valve is degraded.

Conditions being met at 230 may additionally or alternatively include an indication that the fuel system is free from any source of undesired evaporative emissions, as discussed above with regard to step 225 of method 200.

Conditions being met at 230 may additionally or alternatively include an indication that the fuel fill rate is within a range of a desired fuel fill rate for conducting the diagnostic. For example, if the fuel fill rate is determined to be within 7.5-8.5 GPM, then conditions may be indicated to be met for conducting the diagnostic. Other such ranges are possible, without departing from the scope of this disclosure. For example the range for conditions being met for conducting the diagnostic may be 7-8 GPM, 8-9 GPM, 8-10 GPM, etc.

If, at 230, conditions are indicated to be met for conducting the diagnostic as to whether the variable orifice valve is stuck in the low-flow configuration, method 200 may proceed to FIG. 4, where the methodology of method 400 may be used to assess whether the variable orifice valve is stuck in the low-flow configuration, or in other words, is unable to adopt the high-flow configuration.

Alternatively, if at 230 conditions are not indicated to be met for conducting the diagnostic as to whether the variable orifice valve is stuck in the high-flow configuration, method 200 may proceed to 215, where current vehicle operating conditions may be maintained. In other words, refueling may proceed without actively manipulating pressure in the fuel system in order to conduct the diagnostic as to whether the variable orifice valve is stuck in the low-flow configuration. Method 200 may then end.

Regarding the selection at FIG. 2 of whether to initiate the diagnostic pertaining to whether the variable orifice valve is unable to adopt the low-flow configuration, or whether to initiate the diagnostic pertaining to whether the variable orifice valve is unable to adopt the high-flow configuration, it may be understood that in some examples (discussed further below with regard to FIGS. 3-4), both diagnostics may be conducted during the same refueling event. In such an example, the selection of which diagnostic to initiate first may be based on a history of one or more of canister loading states before and after refueling events, canister purging frequency, frequency of bleed-emissions indicated, etc. For example, based on such variables, the controller may select to conduct the diagnostic most likely to indicate a malfunctioning variable orifice valve first, and then to next conduct the other diagnostic. In this way, power may be conserved as opposed to a situation where, for example, a stuck-open diagnostic is performed and where it is determined that the valve is not stuck in the high-flow configuration, and then the stuck-closed diagnostic is performed and then it is determined that the valve is stuck in the low-flow configuration. In other words, by first conducting the diagnostic that is inferred to be most likely to indicate a degraded variable orifice valve, the other diagnostic may not be conducted (under conditions where the first diagnostic indicated valve degradation), which may save on onboard energy storage and improve fuel economy. As an example, if all indications based on canister loading, purging frequency, frequency of bleed emissions, etc., point to the variable orifice valve being stuck in the low-flow configuration, then the diagnostic designed to indicate whether the variable orifice valve is stuck in the low-flow configuration may be selected via the controller to be conducted first during the refueling event, and then to conduct the diagnostic as to whether the variable orifice valve is stuck in the high-flow configuration (provided the outcome of the first diagnostic does not indicate variable orifice valve degradation). It may be understood that in such an example, if the diagnostic indicates the variable orifice valve is stuck in the low-flow configuration, then the controller may abort conducting the diagnostic as to whether the variable orifice valve is stuck in the high-flow configuration. As another example, if all indications based on canister loading, purging frequency, frequency of bleed emissions, etc., point to the variable orifice valve being stuck in the high-flow configuration, then the diagnostic designed to indicate whether the variable orifice valve is stuck in the high-flow configuration may be conducted first and if it is indicated that the valve is not stuck in the high-flow configuration, then the diagnostic pertaining as to whether the valve is stuck in the low-flow configuration may next be conducted.

Turning now to FIG. 3, a flow chart for a high level example method 300 for conducting a diagnostic to determine whether a variable orifice valve (e.g. 54) in a vapor recovery line (e.g. 31) is stuck in a high-flow (also referred to herein as stuck open) position, is shown. More specifically, method 300 includes, during a refueling event, actively manipulating pressure in the fuel system to reduce pressure, and monitoring the effect of such a reduction in pressure on a canister loading rate. If the canister loading rate differs from a first expected canister loading rate by more than a first threshold difference, then it may be indicated that the variable orifice valve is stuck in the high-flow position. In other words, in response to a reduction in fuel system pressure during refueling, it may be expected that the variable orifice valve would close thus directing fuel vapors to the canister, however if the variable orifice valve is stuck open, then less fuel vapors will be routed to the canister. Thus, by monitoring a rate of canister loading during such a diagnostic, and comparing the rate to the first expected canister loading rate (the expected rate assuming the variable orifice valve is not degraded), it may be determined as to whether the variable orifice valve is stuck in the high-flow position. For monitoring the rate of canister loading, a canister temperature sensor (e.g. 32) may be utilized, where a rate of change in temperature during refueling is used via the controller (e.g. 12) to infer the rate of canister loading.

Method 300 will be described with reference to the systems described herein and shown in FIG. 1, though it should be understood that similar methods may be applied to other systems without departing from the scope of this disclosure. Method 300 may be carried out by a controller, such as controller 12 in FIG. 1, and may be stored at the controller as executable instructions in non-transitory memory. Instructions for carrying out method 300 and the rest of the methods included herein may be executed by the controller based on instructions stored on a memory of the controller and in conjunction with signals received from sensors of the engine system, such as the sensors described above with reference to FIG. 1. The controller may employ fuel system and evaporative emissions system actuators, such as canister purge valve (CPV) (e.g. 61), canister vent valve (CVV) (e.g. 29), FTIV (e.g. 52), variable orifice valve actuator (e.g. 56) (where applicable), etc., to alter states of devices in the physical world according to the methods depicted below.

Method 300 begins at 330 and may include monitoring a rate of canister temperature increase. As discussed, the rate of canister temperature increase may be determined via the use of one or more canister temperature sensor(s) (e.g. 32). Readings from the one or more canister temperature sensor (s) may be provided to the controller periodically, for example every 0.5 seconds or less, every 1 second, every 5 seconds, every 10 seconds, etc. It may be understood that monitoring the canister temperature rise rate at 330 may be conducted once fuel system pressure reaches a steady state during the refueling event. In other words, once fuel system pressure is not changing by more than a threshold amount (e.g. not changing by more than 0.5-2%, or not changing by more than 3%), then steady state fuel system pressure conditions during refueling may be indicated. Step 330 may be conducted for 5 seconds, 10 seconds, 20 seconds, 25 seconds, 30 seconds, greater than 30 seconds but less than 2 minutes, etc.

Proceeding to 335, method 300 may include extrapolating a first expected canister temperature rise profile or rate (e.g. first expected canister loading rate) given the fuel fill rate in GPM, and the monitored canister temperature rise rate. In other words, the controller may generate a first expected canister temperature rise profile based on a model that accounts for the determined fuel fill rate in GPM and monitored canister temperature rise. The canister temperature rise profile may be modeled as a further function of a maximum amount of fuel that can be added to the tank. In other words, a current fuel fill level may be compared to a maximum fuel fill level for the fuel tank, such that the first expected canister temperature rise profile reflects expected canister temperature rise under conditions where the fuel tank is filled to capacity. In this way, even if the refueling event does not include filling the fuel tank to its capacity, the first expected canister temperature rise profile will comprise expected canister temperature rise for the duration of the refueling event. Still further, the first expected canister temperature rise profile may be modeled as a further function of a duty cycle of the CPV, the duty cycling of the CPV commanded at step 340 below. Still further, the first expected canister temperature rise profile may be modeled as if the variable orifice valve is not degraded. In other words, the first expected canister temperature rise profile may account for the CPV being duty cycled and in response to the CPV being duty cycled, the variable orifice valve closing (adopting the low-flow configuration if not degraded) as a function of the CPV duty cycle. The first expected canister temperature rise profile may be stored at the controller.

With the first expected canister temperature rise profile stored at the controller at 335, method 300 may proceed to 340. At 340, method 300 may include duty cycling the CPV at a predetermined rate. It may be understood that, during refueling, the FTIV and the CVV are open, to allow fuel vapors to migrate to the canister. The CPV is closed for refueling, however at 340, method 300 includes duty cycling the CPV at the predetermined rate. By duty cycling the CPV, pressure in the fuel system and evaporative emissions system may be reduced, as a pathway to the engine is established as a means of relieving fuel system and evaporative emissions system pressure. The duty cycle for the CPV may be commanded such that pressure in the fuel system is expected to be such that the variable orifice valve would close to its maximal extent (e.g. the low-flow position). As an example, the CPV may be duty cycled such that pressure in the fuel system becomes below the first threshold pressure (e.g. below 4-5 GPM) and with pressure as such, the variable orifice valve would be expected to occupy the low-flow position. More specifically, if the actuator (e.g. 56) of the variable orifice valve is a spring-based actuator, then the reduction of pressure in the fuel system would be expected to result in less pressure acting on the spring, whereby the orifice (e.g. 53) of the variable orifice valve would close if the valve is not degraded. If the actuator comprises an electromechanical actuator under control of the vehicle controller, then the reduction in pressure in the fuel system may be communicated to the controller, and the controller may control the actuator (e.g. 56) to adopt the low-flow position, if the variable orifice valve is not degraded. However, if the variable orifice valve is stuck in the high-flow configuration, then the reduction in pressure in the fuel system due to duty cycling the CPV may not translate into the variable orifice valve adopting the low-flow configuration.

To assess whether the variable orifice valve has adopted the low-flow configuration, or remains stuck in the high-flow configuration, canister temperature may again be monitored, and the rate of canister temperature rise compared to the first expected canister temperature rise profile. Accordingly, proceeding to 345, method 300 may include monitoring canister temperature in order to determine a canister temperature rise rate. Again, temperature measurements may be obtained periodically for a predetermined period of time. For example, temperature measurements may be obtained every 1 second, every 5 seconds, every 10 seconds, etc. The predetermined time may comprise 30 seconds, 45 seconds, 60 seconds, 90 seconds, 120 seconds, etc. It may be understood that by duty cycling the CPV, and thus creating a pathway to the engine, some amount of fuel vapors may be routed to the intake of the engine. However, such fuel vapors may be adsorbed in the intake via an AIS HC trap (e.g. 169). In some examples, the predetermined time for obtaining the temperature measurements may be a function of avoiding the potential for release of fuel vapors to atmosphere. In other words, the predetermined time may be short enough that all fuel vapors that migrate to engine intake may be adequately adsorbed via the AIS HC trap. The predetermined time may additionally or alternatively comprise an amount of time where robust results may be expected to be obtained via the diagnostic.

Proceeding to 350, method 300 may include indicating whether the canister temperature rise rate determined at step 345 differs from the expected canister temperature rise rate by more than a first threshold difference. The first threshold difference may comprise a 5% difference, a 10% difference, etc. It may be understood that if the variable orifice valve is stuck open (unable to adopt the low-flow configuration), then less fuel vapors will be routed to the canister than would otherwise be expected to be routed to the canister, while the CPV is being duty cycled.

If, at 350, the canister temperature rise rate is not different than (not less than) the expected canister temperature rise rate by more than the first threshold difference, method 300 may proceed to 355. At 355, method 300 may include indicating that the variable orifice valve is functioning as desired, or in other words, is not degraded. In other words, in response to the active reduction in fuel system pressure during the refueling event, the variable orifice valve adopted the low-flow position, as expected for a valve that is not degraded. The result may be stored at the vehicle controller at 355.

Proceeding to 360, method 300 may include the controller sending a signal to the CPV, commanding the CPV to be stopped from being duty cycled, and commanding the CPV closed. Continuing at 365, method 300 may include determining whether conditions are met for conducting the stuck-closed diagnostic. More specifically, as discussed above with regard to FIG. 2, there may be circumstances where both diagnostics (stuck open and stuck closed diagnostics) are conducted during the same refueling event. Thus, conditions being met at 365 may comprise the same set of conditions as that depicted above at step 230 of FIG. 2. However, in some examples conditions being met at 365 may additionally or alternatively include an indication that the variable orifice valve is not stuck in the high-flow configuration as indicated via the method of FIG. 3, and thus it is desired or requested to check whether the variable orifice valve is stuck in the low-flow configuration. If, at 365, conditions are met for conducting the diagnostic pertaining to whether the variable orifice valve is stuck in the low-flow configuration or in other words, is unable to adopt the high-flow configuration, method 300 may proceed to FIG. 4 where method 400 may be used to conduct the stuck closed diagnostic.

Alternatively, if conditions are not indicated to be met for conducting the stuck closed diagnostic, method 300 may proceed to 370. At 370, method 300 may include proceeding with the refueling event in progress. While not explicitly illustrated, it may be understood that the refueling event may proceed until fuel has stopped being added to the tank, at which point the FTIV may be commanded closed. At 375, method 300 may include updating vehicle operating parameters. For example, in response to the indication that the variable orifice valve is not stuck in the high-flow position, updating vehicle operating parameters may include maintaining a current canister purge schedule as-is at the controller. Updating vehicle operating parameters at 370 may further include updating a loading state of the fuel vapor canister to reflect the refueling event where fuel vapors were added to the canister. Updating vehicle operating parameters at 370 may further include updating a level of fuel in the fuel tank, to reflect the refueling event. Method 300 may then end.

Returning to 350, if the canister temperature rise rate is different than (less than) the first expected canister temperature rise rate by more than the first threshold difference, then method 300 may proceed to 380. At 380, method 300 may include indicating that the variable orifice valve is stuck in the high-flow position. In other words, because canister temperature rise rate is less than the first expected canister rise rate by more than the first threshold difference, the variable orifice valve did not adopt the low-flow position as expected when pressure in the fuel system was actively reduced via the duty cycling of the CPV. Accordingly, less fuel vapors were routed to the canister than expected. The result may be stored at the controller at 380.

Proceeding to 360, method 300 may include stopping the duty cycling of the CPV, and the CPV may be commanded closed. Proceeding to 365, it may be determined whether conditions are met for conducting the stuck closed variable orifice valve diagnostic. Under conditions where the variable orifice valve has been determined to be unable to adopt the low-flow configuration, it may be understood that conditions would not be met for conducting the stuck closed diagnostic. Accordingly, method 300 may proceed to 370 where refueling may proceed, and upon completion of refueling, the FTIV may be commanded closed. At 375, method 300 may include setting a flag at the controller indicating the degradation of the variable orifice valve. A malfunction indicator light (MIL) may be illuminated at the vehicle dash, alerting the vehicle operator of a request to service the vehicle. Canister loading state and fuel level in the fuel tank may be updated at 375 to reflect the refueling event. Updating vehicle operating parameters at 375 may include scheduling the vehicle to duty cycle the CPV during future refueling events for brief periods of time, to provide a route for fuel vapors to travel to the engine intake where they may be adsorbed by the AIS HC trap, rather than being routed to atmosphere through the fuel fill inlet due to the variable orifice valve being stuck in the high-flow position. Method 300 may then end.

While method 300 depicts an example diagnostic for determining whether the variable orifice valve is stuck in the high-flow configuration, as discussed there may be other circumstances where the variable orifice valve becomes stuck in the low-flow configuration (unable to adopt the high-flow configuration). To diagnose such a condition in similar fashion to that described above at FIG. 3, pressure in the fuel system may be actively increased during refueling, which would be expected to result in the variable orifice valve adopting a high-flow configuration. However, if the valve does not adopt the high-flow configuration due to its being stuck in the low-flow configuration, then a canister loading rate may be increased as compared to an expected canister loading rate.

Accordingly, turning to FIG. 4, a flow chart for a high level example method 400 for conducting a diagnostic to determine whether a variable orifice valve (e.g. 54) in a vapor recovery line (e.g. 31) is stuck in a low-flow (also referred to herein as stuck closed) position, or in other words is unable to adopt the high-flow position, is shown. More specifically, method 400 includes, during a refueling event, actively manipulating pressure in the fuel system to increase pressure, and monitoring the effect of such an increase in pressure on a canister loading rate. If the canister loading rate differs from a second expected canister loading rate by more than a second threshold difference, then it may be indicated that the variable orifice valve is stuck in the low-flow position. In other words, in response to an increase in fuel system pressure during refueling, it may be expected that the variable orifice valve would open, thus directing less fuel vapors to the canister, as a greater proportion of fuel vapors are recirculated back to the fuel tank. However, if the variable orifice valve is stuck closed, then a greater than expected amount of fuel vapors will be routed to the canister. Thus, by monitoring the rate of canister loading during such a diagnostic, and comparing the rate to the second expected canister loading rate (the second expected rate assuming the variable orifice valve is not degraded), it may be determined as to whether the variable orifice valve is stuck in the low-flow position. As discussed above at FIG. 3, for monitoring the rate of canister loading, the canister temperature sensor (e.g. 32) may be utilized, where a rate of change in temperature during refueling is used via the controller (e.g. 12) to infer the rate of canister loading.

Method 400 will be described with reference to the systems described herein and shown in FIG. 1, though it should be understood that similar methods may be applied to other systems without departing from the scope of this disclosure. Method 400 may be carried out by a controller, such as controller 12 in FIG. 1, and may be stored at the controller as executable instructions in non-transitory memory. Instructions for carrying out method 400 and the rest of the methods included herein may be executed by the controller based on instructions stored on a memory of the controller and in conjunction with signals received from sensors of the engine system, such as the sensors described above with reference to FIG. 1. The controller may employ fuel system and evaporative emissions system actuators, such as canister purge valve (CPV) (e.g. 61), canister vent valve (CVV) (e.g. 29), FTIV (e.g. 52), variable orifice valve actuator (e.g. 56) (where applicable), etc., to alter states of devices in the physical world according to the methods depicted below.

Numerous steps for the methodology of FIG. 4 are the same as those or essentially equivalent as those described above at FIG. 3. Accordingly, such steps will only be briefly described with regard to FIG. 4 so as to avoid redundancy.

Method 400 begins at 425, and may include monitoring a rate of canister temperature increase. As discussed, the rate of canister temperature increase may be determined via the use of one or more canister temperature sensor(s) (e.g. 32). Readings from the one or more canister temperature sensor (s) may be provided to the controller periodically, for example every 0.5 seconds or less, every 1 second, every 5 seconds, every 10 seconds, etc. It may be understood that monitoring the canister temperature rise rate at 425 may be conducted once fuel system pressure reaches a steady state during the refueling event. In other words, once fuel system pressure is not changing by more than a threshold amount (e.g. not changing by more than 0.5-2%, or not changing by more than 3%), then steady state fuel system pressure conditions during refueling may be indicated. Step 425 may be conducted for 5 seconds, 10 seconds, 20 seconds, 25 seconds, 30 seconds, greater than 30 seconds but less than 2 minutes, etc.

Proceeding to 430, method 400 may include extrapolating a second expected canister temperature rise profile or rate (e.g. second expected canister loading rate) given the fuel fill rate in GPM, and the monitored canister temperature rise rate. Similar to that discussed above, the controller may generate a second expected canister temperature rise profile based on a model that accounts for the determined fuel fill rate in GPM and monitored canister temperature rise. The second canister temperature rise profile may be modeled as a further function of a maximum amount of fuel that can be added to the tank. In other words, a current fuel fill level may be compared to a maximum fuel fill level for the fuel tank, such that the second expected canister temperature rise profile reflects expected canister temperature rise under conditions where the fuel tank is filled to capacity. Still further, the second expected canister temperature rise profile may be modeled as a further function of a duty cycle of the CVV, the duty cycling of the CVV commanded at step 435 below. Still further, the second expected canister temperature rise profile may be modeled as if the variable orifice valve is not degraded. In other words, the second expected canister temperature rise profile may account for the CVV being duty cycled and in response to the CVV being duty cycled, the variable orifice valve opening as a function of the CVV duty cycle. The second expected canister temperature rise profile may be stored at the controller. It may be understood that the model discussed here with regard to FIG. 4 may comprise the same model as that discussed above with regard to FIG. 3. However, in other examples, the model may be different for the method of FIG. 3 as compared to that of FIG. 4.

With the second expected canister temperature rise profile stored at the controller at 430, method 400 may proceed to 435. At 435, method 400 may include duty cycling the CVV at a predetermined rate. It may be understood that, during refueling, the FTIV and the CVV are open and the CPV is closed, to allow fuel vapors to migrate to the canister. However at 435, method 400 includes duty cycling the CVV at the predetermined rate. By duty cycling the CVV, pressure in the fuel system and evaporative emissions system may be increased, as the pathway to the atmosphere is closed off. The duty cycle for the CVV may be commanded such that pressure in the fuel system is expected to be such that the variable orifice valve would open to its maximal extent (e.g. the high-flow position). As an example, the CVV may be duty cycled such that pressure in the fuel system becomes above the second threshold pressure (e.g. above 11-12 GPM) and with pressure as such, the variable orifice valve would be expected to occupy the high-flow position. More specifically, if the actuator (e.g. 56) of the variable orifice valve is a spring-based actuator, then the increase in pressure in the fuel system would be expected to result in a greater pressure acting on the spring, whereby the orifice (e.g. 53) of the variable orifice valve would open if not degraded. If the actuator comprises an electromechanical actuator under control of the vehicle controller, then the increase in pressure in the fuel system may be communicated to the controller, and the controller may control the actuator (e.g. 56) to adopt the high-flow position, if the variable orifice valve is not degraded. However, if the variable orifice valve is stuck in the low-flow configuration, then the increase in pressure in the fuel system due to duty cycling the CVV may not translate into the variable orifice valve adopting the high-flow configuration.

To assess whether the variable orifice valve has adopted the high-flow configuration, or remains stuck in the low-flow configuration, canister temperature may again be monitored, and the rate of canister temperature rise compared to the second expected canister temperature rise profile. Accordingly, proceeding to 440, method 400 may include monitoring canister temperature in order to determine a canister temperature rise rate. Again, temperature measurements may be obtained periodically for a predetermined period of time. For example, temperature measurements may be obtained every 1 second, every 5 seconds, every 10 seconds, etc. The predetermined time may comprise 30 seconds, 45 seconds, 60 seconds, 90 seconds, 120 seconds, etc., and may comprise an amount of time where robust results may be expected to be obtained via the diagnostic.

Proceeding to 445, method 400 may include indicating whether the canister temperature rise rate determined at step 440 differs from the second expected canister temperature rise rate by more than a second threshold difference. The second threshold difference may comprise a 5% difference, a 10% difference, etc. It may be understood that if the variable orifice valve is stuck closed, then a greater amount of fuel vapors will be routed to the canister than would otherwise be expected to be routed to the canister, while the CVV is being duty cycled.

If, at 445, the canister temperature rise rate is not different than (not greater than) the second expected canister temperature rise rate by more than the second threshold difference, method 400 may proceed to 450. At 450, method 400 may include indicating that the variable orifice valve is functioning as desired or in other words, is not degraded. In other words, in response to the active increase in fuel system pressure during the refueling event, the variable orifice valve adopted the high-flow position, as expected for a valve that is not degraded. The result may be stored at the vehicle controller at 450.

Proceeding to 455, method 400 may include the controller sending a signal to the CVV, commanding the CVV to be stopped from being duty cycled, and commanding the CVV closed. Continuing at 460, method 400 may include determining whether conditions are met for conducting the stuck-open diagnostic. More specifically, as discussed above with regard to FIG. 2, there may be circumstances where both diagnostics (stuck open and stuck closed diagnostics) are conducted during the same refueling event. Thus, conditions being met at 460 may comprise the same set of conditions as that depicted above at step 225 of FIG. 2. However, in some examples conditions being met at 460 may additionally or alternatively include an indication that the variable orifice valve is not stuck in the low-flow configuration as indicated via the method of FIG. 4, and thus it is desired or requested to check whether the variable orifice valve is stuck in the high-flow configuration. If, at 460, conditions are met for conducting the diagnostic pertaining to whether the variable orifice valve is stuck in the high-flow configuration or in other words, is unable to adopt the low-flow configuration, method 400 may proceed to FIG. 3 where method 300 may be used to conduct the stuck open diagnostic.

Alternatively, if conditions are not indicated to be met for conducting the stuck open diagnostic, method 400 may proceed to 465. At 465, method 400 may include proceeding with the refueling event in progress. While not explicitly illustrated, it may be understood that the refueling event may proceed until fuel has stopped being added to the tank, at which point the FTIV may be commanded closed. At 470, method 400 may include updating vehicle operating parameters. For example, in response to the indication that the variable orifice valve is not stuck in the low-flow position, updating vehicle operating parameters may include maintaining a current canister purge schedule as-is at the controller. Updating vehicle operating parameters at 370 may further include updating a loading state of the fuel vapor canister to reflect the refueling event where fuel vapors were added to the canister. Updating vehicle operating parameters at 370 may further include updating a level of fuel in the fuel tank, to reflect the refueling event. Method 400 may then end.

Returning to 445, if the canister temperature rise rate is different than (greater than) the second expected canister temperature rise rate by more than the threshold amount, then method 400 may proceed to 475. At 475, method 400 may include indicating that the variable orifice valve is stuck in the low-flow position. In other words, because canister temperature rise rate is greater than the second expected canister rise rate by more than the second threshold difference, the variable orifice valve did not open to adopt the high-flow configuration as expected when pressure in the fuel system was actively increased via the duty cycling of the CVV. Accordingly, a greater amount of fuel vapors were routed to the canister than expected, due to the variable orifice valve being stuck in the low-flow position. The result may be stored at the controller at 470.

Proceeding to 455, method 400 may include stopping the duty cycling of the CVV, and the CVV may be commanded open. Proceeding to 460, it may be determined as to whether conditions are met for conducting the stuck-open diagnostic, however in a case where the valve is already determined to be unable to adopt the high-flow configuration, it may be understood that conditions would not be met for conducting the stuck-open diagnostic. Accordingly, in such an example, method 400 may proceed to 465 where refueling may proceed. Upon completion of refueling, the FTIV may be commanded closed. At 470, method 400 may include setting a flag at the controller indicating the degradation of the variable orifice valve. A malfunction indicator light (MIL) may be illuminated at the vehicle dash, alerting the vehicle operator of a request to service the vehicle. Canister loading state and fuel level in the fuel tank may be updated at 470 to reflect the refueling event. Updating vehicle operating parameters at 470 may include scheduling purging of the canister at the first available opportunity to rapidly clean the canister of fuel vapors after refueling events, as the canister may be loaded to a greater extent than usual and which may thus lead to bleed emissions if not rapidly cleaned. As one example, for hybrid vehicles where engine run-time may be limited, after refueling if the vehicle is activated in an electric-only mode of operation, the controller may command on the engine in order to purge the canister, rather than waiting for the next engine-on event. Method 400 may then end.

Thus, the methods described above may enable a method for a vehicle comprising actively manipulating a pressure in a fuel system while fuel is being added thereto, the fuel system fluidically coupled to an evaporative emissions system including a fuel vapor canister, and indicating whether a variable orifice valve positioned in a fuel vapor recovery line of the fuel system is degraded based on a rate of loading of the canister with fuel vapors while the pressure is actively manipulated.

In such a method, the fuel vapor recovery line recirculates fuel vapors back to a fuel tank of the fuel system to reduce an amount of fuel vapors that loads the fuel vapor canister. The rate of canister loading may be indicated via a rate of change in temperature of the fuel vapor canister.

In such a method, the method may further comprise indicating that the variable orifice valve is not degraded when the rate of loading of the canister is within a threshold difference of an expected canister loading rate during the actively manipulating the pressure. Actively manipulating the pressure may include increasing the pressure by periodically sealing the fuel system and evaporative emissions system from atmosphere. Alternatively, actively manipulating the pressure may include decreasing the pressure by periodically fluidically coupling the fuel system and evaporative emissions system to an intake of an engine of the vehicle.

In one example of such a method, the variable orifice valve may be passively mechanically actuated based on an amount of the pressure in the fuel system. In another example, the variable orifice valve may be electromechanically actuated based on an amount of the pressure in the fuel system. Furthermore, the variable orifice valve may occupy a low-flow configuration when the pressure is below a first threshold pressure, and may occupy a high-flow configuration when the pressure is greater than a second threshold pressure.

In another example, the methods described above may enable a method comprising during refueling a fuel tank positioned in a fuel system of a vehicle, in a first condition, operating an evaporative emissions system selectively fluidically coupled to the fuel tank in a first mode to decrease pressure in the fuel tank. The method may include, in a second condition, during refueling the fuel tank, operating the evaporative emissions system in a second mode to increase pressure in the fuel tank, and in both the first condition and the second condition, indicating whether a variable orifice valve positioned in a vapor recovery line of the fuel system is degraded based on a rate at which a fuel vapor canister is loaded with fuel vapors during the decreasing pressure and the increasing pressure, respectively.

In an example of such a method, the variable orifice valve may open and close to varying extents as a function of fuel system pressure. The first condition may include an indication that the variable orifice valve is not capable of closing to its maximal extent and the second condition may include an indication that the variable orifice valve is not capable of opening to its maximal extent.

In such a method, the method may include indicating the variable orifice valve is stuck in a high-flow configuration in response to the rate at which the fuel vapor canister is loaded with fuel vapors being outside of a first threshold difference from a first expected canister loading rate while operating the evaporative emissions system in the first mode. The method may further include indicating the variable orifice valve is stuck in a low-flow configuration in response to the rate at which the fuel vapor canister is loaded with fuel vapors being outside of a second threshold difference from a second expected canister loading rate while operating the evaporative emissions system in the second mode.

In such a method, the rate at which the fuel vapor canister is loaded with fuel vapors in both the first condition and the second condition is indicated based on a temperature change of the fuel vapor canister.

In such a method, operating the evaporative emissions system in the first mode to decrease pressure in the fuel system may include duty cycling a canister purge valve positioned in a purge line fluidically coupling the evaporative emissions system to an intake of an engine, and wherein operating the evaporative emissions system in the second mode to increase pressure in the fuel system may include duty cycling a canister vent valve positioned in a vent line fluidically coupling the evaporative emissions system to atmosphere. In such an example, duty cycling the canister purge valve may include controlling a duty cycle of the canister purge valve so that the variable orifice valve closes to its maximum extent possible provided the variable orifice valve is not degraded. Alternatively, duty cycling the canister vent valve may include controlling a duty cycle of the canister vent valve so that the variable orifice valve opens to its maximum extent possible provided the variable orifice valve is not degraded.

In such a method, the variable orifice vale is one of passively mechanically actuated or electromechanically actuated as a function of fuel system pressure.

In one example of such a method, operating the evaporative emissions system in the first mode and operating the evaporative emissions system in the second mode both occur during a same refueling event of the fuel tank.

Turning now to FIG. 5, it illustrates an example timeline 500 for conducting a diagnostic to determine whether the variable orifice valve is stuck in the high-flow configuration (otherwise referred to herein as stuck open), according to the method of FIG. 3. Timeline 500 includes plot 505, indicating whether a refueling event is indicated (yes or no), and plot 510, indicating fuel level in the fuel tank as monitored via a fuel level indicator (FLI), over time. Fuel level in the fuel tank may increase (+) or decrease (−) over time. Timeline 500 further includes plot 515, indicating whether conditions are met for conducting the stuck-open (S.O.) variable orifice valve (VOV) diagnostic (yes or no), over time. Timeline 500 further includes plot 520, indicating temperature of the fuel vapor canister (e.g. 22), as monitored via a temperature sensor (e.g. 32), over time. Canister temperature may increase (+) or decrease (−), over time. Timeline 500 further includes plot 525, indicating a status of the CPV (e.g. 61), plot 530, indicating a status of the CVV (e.g. 29), and plot 535, indicating a status of the FTIV (e.g. 52), over time. The CPV, CVV, and FTIV may be either open or closed, over time. Timeline 500 further includes plot 540, indicating pressure in the fuel system as monitored by the FTPT (e.g. 91), over time. In this example timeline pressure in the fuel system may be either at atmospheric pressure, or increased (+) as compared to atmospheric pressure. Timeline 500 further includes plot 545, indicating whether the VOV is stuck in the high-flow configuration (stuck open) (yes or no), over time.

At time t0, a refueling event is not indicated (plot 505), and thus conditions are not indicated to be met for conducting the diagnostic as to whether the VOV is stuck in the high-flow position (plot 515). Fuel level in the fuel tank is relatively low (plot 510), and a temperature of the fuel vapor storage canister is also low (plot 520). More specifically, the FTIV is closed (plot 535), and thus the canister is not currently in the process of adsorbing fuel vapors, hence the low temperature of the canister. The CPV is closed (plot 525) and thus it may be understood that a canister purging operation is not currently in progress. The CVV is open (plot 530), thus the fuel vapor storage canister is coupled to atmosphere. As the FTIV is closed, pressure in the fuel tank is greater than atmospheric pressure (plot 540). In other words, pressure has built in the sealed fuel tank. At time t0 it has not been yet conclusively indicated that the VOV is stuck open (plot 545). Thus, while not explicitly illustrated, it may be understood that at time t0 the vehicle is in operation, being propelled by either engine operation, electrical operation, or some combination. In this example, the vehicle is traveling to a fuel filling station.

Accordingly, at time t1, the vehicle has reached the fuel filling station and a request for refueling has been initiated by the vehicle operator (plot 505). Accordingly, the vehicle controller receives the request, and commands open the FTIV (plot 535), in order to depressurize the fuel tank prior to fuel being added to the tank. With the fuel tank thus coupled to atmosphere, pressure in the fuel system decays to atmospheric pressure between time t1 and t2.

At time t3, fuel is commenced being added to the fuel tank. Pressure builds in the fuel system (plot 540) between time t3 and t4, the result of the fuel being added to the tank. The pressure reaches a steady state between time t3 and t4, represented by line 541. With the pressure having reached the steady state, the vehicle controller determines the current date (e.g. via wireless communication with the internet or some other means like GPS, etc.), such that the appropriate lookup table is queried to determine the fuel fill rate in GPM. In this example, it may be understood that by time t4, the controller has queried the appropriate lookup table and has indicated that the fuel fill rate is within the range of a desired fuel fill rate for conducting the diagnostic. In this example timeline, it may be understood that the fuel fill rate is determined to be 8 GPM.

With the fuel fill rate determined to be within the range of the desired fuel fill rate for conducting the diagnostic, conditions are indicated to be met for conducting the diagnostic (plot 515). As discussed above at step 225 of method 200, conditions being met also include an indication that the fuel system is free from a presence of undesired evaporative emissions. Conditions being met further include an indication that the test diagnostic is requested. Such a request may be in relation to a predetermined amount of time elapsing since the valve functionality was last assessed, an indication that the canister is being loaded to a lesser than expected amount during refueling events (monitored for example via the canister temperature sensor), that requests to purge the canister are less frequent than expected if the VOV was functioning as expected, etc.

With conditions being met at time t4, it may be understood that the controller determines the current canister temperature rise rate/profile. From the current temperature rise rate (among other things as discussed further below), the controller extrapolates the first expected canister temperature rise rate. More specifically, the first expected canister temperature rise rate comprises the rate at which canister temperature is expected to rise throughout the diagnostic procedure, provided that the VOV is not degraded. Thus, the first expected canister temperature rise rate is determined based on the model described above with regard to FIG. 3. Specifically, the model factors in the current temperature rise rate, the current fuel fill rate, a duty cycle of the CPV that will achieve a pressure in the fuel system that is below the first threshold (e.g. below 4-5 GPM), and how all these factors impact the current temperature rise rate in order to extrapolate the first expected canister temperature rise rate under the assumption that the VOV is not degraded (in other words, that the VOV will occupy the low-flow position when the CPV is duty cycled to reduce pressure in the fuel system to below the first threshold).

In this example timeline 500, the first expected canister temperature rise rate is illustrated by dashed line 522, as determined via the controller using the model described. With the first expected canister temperature rise rate established via the controller, the CPV is commenced being duty cycled at a determined duty cycle, the determined duty cycle comprising a duty cycle for which pressure in the fuel system will be reduced to below the first threshold, as discussed. Accordingly, with the CPV being duty cycled starting at time t4, pressure in the fuel system is reduced to below the first threshold, the first threshold represented by dashed line 542.

With the CPV being duty cycled, canister temperature is monitored, represented by plot 520. In this example timeline, the canister temperature rise rate is within the first threshold difference 523 from the first expected canister temperature rise rate 522. Accordingly, in this example timeline, the VOV is not indicated to be stuck in the high-flow configuration (plot 545). However, dashed line 521 is illustrated to depict an example where the rate of canister temperature rise is not within the first threshold difference 523 of the first expected canister temperature rise rate 522. In such an example, the VOV would be indicated to be stuck in the high-flow position, represented by dashed line 546. In other words, because the canister temperature rise rate is less than would be expected if the VOV were not degraded, in such an example, fuel vapors are not being routed to the canister as expected due to the VOV being stuck in the high-flow configuration.

As in this example timeline, the VOV is not indicated to be stuck in the high-flow configuration, conditions are no longer indicated to be met at time t5 for conducting the diagnostic (plot 515). Accordingly, the CPV is commanded closed (plot 525). With the CPV commanded closed, between time t5 and t6, pressure in the fuel system again builds to the steady state previously reached with the CPV closed (see dashed line 541). Refueling of the fuel tank proceeds between time t5 and t6 (plot 510). It may be understood that in this example timeline, conditions were not indicated to be met for conducting the stuck-closed diagnostic, and thus refueling is allowed to proceed. However, as discussed above, there may be situations where both diagnostics are conducted in the same refueling event.

At time t6, a rapid increase in pressure builds in the fuel tank. It may be understood that the pressure builds because the FLVV closes due to the fuel tank being filled to capacity, and with the FLVV closed, pressure builds which results in an automatic shutoff of the fuel dispenser. Accordingly, between time t6 and t7, pressure in the fuel system rapidly returns to atmospheric pressure, and refueling is no longer indicated to be requested (plot 505). With pressure at atmospheric pressure in the fuel system, the FTIV is commanded closed (plot 535). Between time t7 and t8, while not explicitly illustrated, it may be understood that vehicle operating conditions are updated in response to the refueling event. Specifically, fuel level in the fuel tank is updated, and canister loading state is updated.

Turning now to FIG. 6, it illustrates an example timeline 600 for conducting a diagnostic for determining whether the variable orifice valve (e.g. 54) is stuck in the low-flow configuration (otherwise referred to herein as stuck closed), according to the method of FIG. 4. Timeline 600 includes plot 605, indicating whether a refueling event is indicated (yes or no), and plot 610, indicating fuel level in the fuel tank as monitored via a fuel level indicator (FLI), over time. Fuel level in the fuel tank may increase (+) or decrease (−) over time. Timeline 600 further includes plot 615, indicating whether conditions are met for conducting the stuck-closed (S.C.) variable orifice valve (VOV) diagnostic (yes or no), over time. Timeline 600 further includes plot 620, indicating temperature of the fuel vapor canister (e.g. 22), as monitored via a temperature sensor (e.g. 32), over time. Canister temperature may increase (+) or decrease (−), over time. Timeline 600 further includes plot 625, indicating a status of the CVV (e.g. 29), plot 630, indicating a status of the CPV (e.g. 61), and plot 635, indicating a status of the FTIV (e.g. 52), over time. The CPV, CVV, and FTIV may be either open or closed, over time. Timeline 600 further includes plot 640, indicating pressure in the fuel system as monitored by the FTPT (e.g. 91), over time. In this example timeline pressure in the fuel system may be either at atmospheric pressure, or increased (+) as compared to atmospheric pressure. Timeline 600 further includes plot 645, indicating whether the VOV is stuck in the low-flow configuration (stuck closed) (yes or no), over time.

At time t0, a refueling event is not indicated (plot 605), and thus conditions are not indicated to be met for conducting the diagnostic as to whether the VOV is stuck in the low-flow configuration (plot 615). Fuel level in the fuel tank is relatively low (plot 610), and because the FTIV is closed (plot 635), canister temperature is low (plot 620). The CVV is open (plot 625), thus the canister is fludically coupled to atmosphere. The CPV is closed (plot 630), thus a canister purging event is not in progress. As the FTIV is closed, pressure in the sealed fuel system is greater than atmospheric pressure. In this example timeline, it may be understood that at time t0, the vehicle is in operation, being propelled via engine operation, electrical operation, or some combination of both. It may be understood that the vehicle is traveling to a fuel filling station. At time t0, it has not yet been conclusively indicated that the VOV is stuck in the low-flow configuration (plot 645).

At time t1, refueling is requested via the vehicle operator (plot 605). Accordingly, the FTIV is commanded fully open (plot 635), and with the fuel tank fluidically coupled to atmosphere, pressure in the fuel system rapidly decays to atmospheric pressure between time t1 and t2. At time t3, fuel is commenced being added to the fuel tank (plot 610). Accordingly, pressure in the fuel system increases between time t3 and t4, and reaches a steady state pressure, represented by dashed line 641. With the pressure having reached the steady state, the vehicle controller determines the current date (e.g. via wireless communication with the internet or some other means like GPS, etc.), such that the appropriate lookup table is queried to determine the fuel fill rate in GPM. In this example, it may be understood that by time t4, the controller has queried the appropriate lookup table and has indicated that the fuel fill rate is within the range of a desired fuel fill rate for conducting the diagnostic. In this example timeline, it may be understood that the fuel fill rate is determined to be 8 GPM.

With the fuel fill rate determined to be within the range of the desired fuel fill rate for conducting the diagnostic, conditions are indicated to be met for conducting the diagnostic (plot 615). As discussed above at step 230 of method 200, conditions being met also include an indication that the fuel system is free from a presence of undesired evaporative emissions. Conditions being met further include an indication that the test diagnostic is requested. Such a request may be in relation to a predetermined amount of time elapsing since the valve functionality was last assessed, an indication that the canister is being loaded to a greater than expected amount during refueling events (monitored for example via the canister temperature sensor), that requests to purge the canister are more frequent than expected if the VOV was not degraded, that a frequency of bleed-through emissions from the canister is increased as compared to that expected if the VOV were not degraded, etc.

With conditions being met at time t4, it may be understood that the controller determines the current canister temperature rise rate/profile. From the current temperature rise rate (among other things as discussed further below), the controller extrapolates the second expected canister temperature rise rate. More specifically, the second expected canister temperature rise rate comprises the rate at which canister temperature is expected to rise throughout the diagnostic procedure of FIG. 4, provided that the VOV is not degraded. Thus, the second expected canister temperature rise rate is determined based on the model described above with regard to FIG. 4. Specifically, the model factors in the current temperature rise rate, the current fuel fill rate, a duty cycle of the CVV that will achieve a pressure in the fuel system that is greater than the second threshold (e.g. above 11-12 GPM), and how all these factors impact the current temperature rise rate in order to extrapolate the second expected canister temperature rise rate under the assumption that the VOV is functioning as desired (in other words, that the VOV will occupy the high-flow position when the CVV is duty cycled to increase pressure in the fuel system to above the second threshold).

In this example timeline 600, the second expected canister temperature rise rate is illustrated by dashed line 622, as determined via the controller using the model described. With the second expected canister temperature rise rate established via the controller, the CVV is commenced being duty cycled at a determined duty cycle, the determined duty cycle comprising a duty cycle for which pressure in the fuel system will be increased to above the second threshold, as discussed. Accordingly, with the CVV being duty cycled starting at time t4, pressure in the fuel system is increased to above the second threshold, the second threshold represented by dashed line 642.

With the CVV being duty cycled, canister temperature is monitored, represented by plot 620. In this example timeline, the canister temperature rise rate is within the second threshold difference 623 from the second expected canister temperature rise rate 622. Accordingly, in this example timeline, the VOV is not indicated to be stuck in the low-flow configuration (plot 645). However, dashed line 621 is illustrated to depict an example where the rate of canister temperature rise is not within the second threshold difference 623 of the second expected canister temperature rise rate 622. In such an example, the VOV would be indicated to be stuck in the low-flow position, represented by dashed line 646. In other words, because the canister temperature rise rate is greater than would be expected if the VOV were not degraded, in such an example, fuel vapors are being routed to the canister more than would otherwise be expected due to the VOV being stuck in the low-flow configuration.

As in this example timeline, the VOV is not indicated to be stuck in the low-flow configuration, conditions are no longer indicated to be met at time t5 for conducting the diagnostic (plot 615). Accordingly, the CVV is commanded open (plot 625). With the CVV commanded open, between time t5 and t6, pressure in the fuel system again returns to the steady state previously reached with the CVV open (see dashed line 641). Refueling of the fuel tank proceeds between time t5 and t6 (plot 610). It may be understood that in this example timeline, conditions are not indicated to be met for conducting the stuck-open diagnostic subsequent to conducting the diagnostic for the valve being stuck in the low-flow configuration. However, as discussed, there may be examples where following an indication that the valve is not stuck in the low-flow configuration, the diagnostic as to whether the valve is stuck in the high-flow configuration is conducted during the same refueling event as discussed above.

At time t6, a rapid increase in pressure builds in the fuel tank. It may be understood that the pressure builds because the FLVV closes due to the fuel tank being filled to capacity, and with the FLVV closed, an automatic shutoff of the fuel dispenser is induced. Accordingly, between time t6 and t7, pressure in the fuel system rapidly returns to atmospheric pressure, and refueling is no longer indicated to be requested (plot 605) at time t7. With pressure at atmospheric pressure in the fuel system, the FTIV is commanded closed (plot 535). Between time t7 and t8, while not explicitly illustrated, it may be understood that vehicle operating conditions are updated in response to the refueling event. Specifically, fuel level in the fuel tank is updated, and canister loading state is updated.

As discussed, while the timelines discussed herein and with regard to FIGS. 5-6 depict conducting either the diagnostic pertaining to whether the variable orifice valve is stuck in the high-flow position, or the diagnostic pertaining to whether the variable orifice valve is stuck in the low-flow position for a particular refueling event, it is herein recognized that there may be opportunity to conduct both the method of FIG. 3 and the method of FIG. 4 during one refueling event. In such examples, based on a history of one or more of canister loading states before and after refueling events, canister purging frequency, frequency of bleed-emissions indicated, etc., the controller may select to conduct the diagnostic most likely to indicate a malfunctioning variable orifice valve first, and then to next conduct the other diagnostic. As an example, if all indications based on canister loading, purging frequency, frequency of bleed emissions, etc., point to the variable orifice valve being stuck in the low-flow configuration, then the diagnostic designed to indicate whether the variable orifice valve is stuck in the low-flow configuration may be selected via the controller to be conducted first during the refueling event, and then to conduct the diagnostic as to whether the variable orifice valve is stuck in the high-flow configuration. It may be understood that in such an example, if the diagnostic indicates the variable orifice valve is stuck in the low-flow configuration, then the controller may abort conducting the diagnostic as to whether the variable orifice valve is stuck in the high-flow configuration. As another example, if all indications based on canister loading, purging frequency, frequency of bleed emissions, etc., point to the variable orifice valve being stuck in the high-flow configuration, then the diagnostic designed to indicate whether the variable orifice valve is stuck in the high-flow configuration may be conducted first and if it is indicated that the valve is not stuck in the high-flow configuration, then the diagnostic pertaining as to whether the valve is stuck in the low-flow configuration may next be conducted.

Discussed herein, a method may comprise, during a refueling event determining a first operating condition, and in response thereto performing the action of operating the evaporative emissions system that is selectively fluidically coupled to the fuel tank in a first mode to decrease pressure in the fuel tank. The decreasing the pressure may be conducted via duty cycling the CPV as discussed herein. The first operating condition may include an indication that canister purging operations are not being requested via the controller as frequently as expected or predicted as a function of refueling events, diurnal temperature fluctuations, engine run-time, etc. Such a method may further include determining a second operating condition that is not the same as the first operating condition, and in response thereto performing the action of operating the evaporative emissions system in a second mode to increase pressure in the fuel tank. The increasing the pressure in the fuel tank may be conducted via duty cycling the CVV as discussed herein. The second operating condition may include an indication that the controller is requesting/scheduling canister purging events more frequently than would otherwise be expected. In other words, the second operating condition may include an indication that the canister is being loaded to greater extents than would be expected for particular refueling events. The second operating condition may additionally or alternatively include an indication that bleed-emissions from the canister are occurring more frequently than expected. In some examples, during a refueling event, the controller may select whether to operate the evaporative emissions system in the first mode or the second mode, based data from one or more sensors, such as a canister temperature sensor (e.g. 32). The data may comprise data over a predetermined time period, the predetermined time period including a time period where a threshold number of refueling events (e.g. 1 or more) have occurred and/or where a threshold number of canister purging events (e.g. 1 or more) have occurred. The predetermined time period may include a predetermined duration. In some examples, selecting whether to operate the evaporative emissions system in the first mode or the second mode may include selecting to operate the evaporative emissions system in the first mode and then to operate the evaporative emissions system in the second mode, during a same refueling event. In other examples, selecting whether to operate the evaporative emissions system in the first mode or the second mode may include selecting to operating the evaporative emission system in the second mode and then to operate the evaporative emissions system in the first mode, during a same refueling event.

In this way, a variable orifice valve in a fuel vapor recovery line in a vehicle fuel system may be diagnosed as to whether it is stuck in a high-flow or low-flow configuration. By conducting such diagnostics, bleed-through emissions, either break-through from the canister or break-through from the fuel filler inlet, may be reduced or avoided. Canister function and lifetime may be improved/extended.

The technical effect is to recognize that by artificially manipulating pressure in the fuel system during refueling events and monitoring canister temperature, a diagnosis as to whether the variable orifice valve is degraded or not, may be enabled. More specifically, a technical effect is to recognize that duty cycling the CPV during refueling may decrease pressure in the fuel system such that the variable orifice valve may adopt a closed configuration if not degraded. By monitoring canister temperature, and comparing a rate at which canister temperature rises under such conditions to an expected canister temperature rise rate assuming the valve is not degraded, it may be ascertained as to whether the valve is stuck in the high-flow configuration. Along these lines, another technical effect is to recognize that duty cycling the CVV during refueling may increase pressure in the fuel system such that the variable orifice valve may adopt an open configuration if not degraded. In similar fashion as that described above, it may be ascertained as to whether the valve is stuck in the low-flow configuration. Thus, in both cases, a technical effect is to recognize that canister temperature rise rates may be utilized during refueling events to determine whether the variable orifice valve is degraded, as discussed herein.

The systems discussed herein, and as depicted at FIG. 1, along with the methods discussed herein, and with regard to FIGS. 2-4, may enable one or more systems and one or more methods. In one example, a method for a vehicle comprises actively manipulating a pressure in a fuel system while fuel is being added thereto, the fuel system fluidically coupled to an evaporative emissions system including a fuel vapor canister; and indicating whether a variable orifice valve positioned in a fuel vapor recovery line of the fuel system is degraded based on a rate of loading of the canister with fuel vapors while the pressure is actively manipulated. In a first example of the method, the method further includes wherein the fuel vapor recovery line recirculates fuel vapors back to a fuel tank of the fuel system to reduce an amount of fuel vapors that loads the fuel vapor canister. A second example of the method optionally includes the first example, and further includes wherein the rate of canister loading is indicated via a rate of change in temperature of the fuel vapor canister. A third example of the method optionally includes any one or more or each of the first through second examples, and further comprises indicating that the variable orifice valve is not degraded when the rate of loading of the canister is within a threshold difference of an expected canister loading rate during the actively manipulating the pressure. A fourth example of the method optionally includes any one or more or each of the first through third examples, and further includes wherein actively manipulating the pressure includes increasing the pressure by periodically sealing the fuel system and evaporative emissions system from atmosphere. A fifth example of the method optionally includes any one or more or each of the first through fourth examples, and further includes wherein actively manipulating the pressure includes decreasing the pressure by periodically fluidically coupling the fuel system and evaporative emissions system to an intake of an engine of the vehicle. A sixth example of the method optionally includes any one or more or each of the first through fifth examples, and further includes wherein the variable orifice valve is passively mechanically actuated based on an amount of the pressure in the fuel system. A seventh example of the method optionally includes any one or more or each of the first through sixth examples, and further includes wherein the variable orifice valve is electromechanically actuated based on an amount of the pressure in the fuel system. An eighth example of the method optionally includes any one or more or each of the first through seventh examples, and further includes wherein the variable orifice valve occupies a low-flow configuration when the pressure is below a first threshold pressure, and a high-flow configuration when the pressure is greater than a second threshold pressure.

Another example of a method comprises during refueling a fuel tank positioned in a fuel system of a vehicle, in a first condition, operating an evaporative emissions system selectively fluidically coupled to the fuel tank in a first mode to decrease pressure in the fuel tank; in a second condition, during refueling the fuel tank, operating the evaporative emissions system in a second mode to increase pressure in the fuel tank; and in both the first condition and the second condition, indicating whether a variable orifice valve positioned in a vapor recovery line of the fuel system is degraded based on a rate at which a fuel vapor canister is loaded with fuel vapors during the decreasing pressure and the increasing pressure, respectively. A first example of the method includes wherein the variable orifice valve opens and closes to varying extents as a function of fuel system pressure; and wherein the first condition includes an indication that the variable orifice valve is not capable of closing to its maximal extent and wherein the second condition includes an indication that the variable orifice valve is not capable of opening to its maximal extent. A second example of the method optionally includes the first example, and further comprises indicating the variable orifice valve is stuck in a high-flow configuration in response to the rate at which the fuel vapor canister is loaded with fuel vapors being outside of a first threshold difference from a first expected canister loading rate while operating the evaporative emissions system in the first mode; and indicating the variable orifice valve is stuck in a low-flow configuration in response to the rate at which the fuel vapor canister is loaded with fuel vapors being outside of a second threshold difference from a second expected canister loading rate while operating the evaporative emissions system in the second mode. A third example of the method optionally includes the first through second examples, and further includes wherein the rate at which the fuel vapor canister is loaded with fuel vapors in both the first condition and the second condition is indicated based on a temperature change of the fuel vapor canister. A fourth example of the method optionally includes any one or more or each of the first through third examples, and further includes wherein operating the evaporative emissions system in the first mode to decrease pressure in the fuel system includes duty cycling a canister purge valve positioned in a purge line fluidically coupling the evaporative emissions system to an intake of an engine; and wherein operating the evaporative emissions system in the second mode to increase pressure in the fuel system includes duty cycling a canister vent valve positioned in a vent line fluidically coupling the evaporative emissions system to atmosphere. A fifth example of the method optionally includes any one or more or each of the first through fourth examples, and further includes wherein duty cycling the canister purge valve includes controlling a duty cycle of the canister purge valve so that the variable orifice valve closes to its maximum extent possible provided the variable orifice valve is not degraded; and wherein duty cycling the canister vent valve includes controlling a duty cycle of the canister vent valve so that the variable orifice valve opens to its maximum extent possible provided the variable orifice valve is not degraded. A sixth example of the method optionally includes any one or more or each of the first through fifth examples, and further includes wherein the variable orifice valve is one of passively mechanically actuated or electromechanically actuated as a function of fuel system pressure. A seventh example of the method optionally includes any one or more or each of the first through sixth examples, and further includes wherein operating the evaporative emissions system in the first mode and operating the evaporative emissions system in the second mode both occur during a same refueling event of the fuel tank.

An example of a system for a vehicle comprises a fuel system including a fuel tank and a fuel vapor recovery line for recirculating fuel vapors back to the fuel tank; a variable orifice valve positioned in the fuel vapor recovery line; an evaporative emissions system fluidically coupled to the fuel system, the evaporative emissions system including a fuel vapor storage canister; a canister purge valve positioned in a purge line selectively fluidically coupling the fuel vapor storage canister to an intake of an engine; a canister vent valve positioned in a vent line selectively fluidically coupling the fuel vapor storage canister to atmosphere; and a controller with computer readable instructions stored on non-transitory memory that, when executed, cause the controller to: during a refueling event, actively manipulate pressure in the fuel system via duty cycling either the canister purge valve or the canister vent valve; and indicate whether the variable orifice valve is degraded based on a rate at which the fuel vapor storage canister is loaded with fuel vapors during the actively manipulating pressure in the fuel system. In a first example of the system, the system includes wherein the controller stores further instructions to indicate that the variable orifice valve is stuck in a high-flow configuration in response to the rate at which the fuel vapor storage canister is loaded with fuel vapors during duty cycling the canister purge valve being less than a first expected canister loading rate by more than a first threshold difference. A second example of the system optionally includes the first example, and further includes wherein the controller stores further instructions to indicate that the variable orifice valve is stuck in a low-flow configuration in response to the rate at which the fuel vapor storage canister is loaded with fuel vapors during duty cycling the canister vent valve being greater than a second expected canister loading rate by more than a second threshold difference.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle, comprising:

during refueling a fuel tank positioned in a fuel system of the vehicle, actively manipulating a pressure in the fuel system with a fuel tank isolation valve kept open, the fuel system fluidically coupled to an evaporative emissions system including a fuel vapor canister; and indicating whether a variable orifice valve positioned in a fuel vapor recirculation line upstream of the fuel tank isolation valve of the fuel system is degraded based on a rate of loading of the canister with fuel vapors while the pressure is actively manipulated, wherein actively manipulating the pressure includes increasing the pressure by duty cycling a canister vent valve to periodically seal the fuel system and evaporative emissions system from atmosphere, or decreasing the pressure by duty cycling a canister purge valve to periodically fluidically couple the fuel system and the evaporative emissions system to an intake of an engine of the vehicle.

2. The method of claim 1, wherein the fuel vapor recirculation line recirculates fuel vapors back to the fuel tank of the fuel system to reduce an amount of fuel vapors that loads the fuel vapor canister.

3. The method of claim 1, wherein the rate of canister loading is indicated via a rate of change in temperature of the fuel vapor canister;

wherein the rate of change in temperature of the fuel vapor canister is compared to an expected canister temperature rise profile given a determined fuel fill rate; and wherein the expected canister temperature rise profile is further modeled as a function of a maximum amount of fuel that can be added to the fuel tank.

4. The method of claim 1, further comprising:

indicating that the variable orifice valve is not degraded when the rate of loading of the canister is within a threshold difference of an expected canister loading rate during the actively manipulating the pressure.

5. The method of claim 1, wherein the variable orifice valve is passively mechanically actuated based on an amount of the pressure in the fuel system.

6. The method of claim 1, wherein the variable orifice valve is electromechanically actuated based on an amount of the pressure in the fuel system.

7. The method of claim 1, wherein the variable orifice valve occupies a low-flow configuration when the pressure is below a first threshold pressure, and a high-flow configuration when the pressure is greater than a second threshold pressure.

8. A method, comprising:

during refueling a fuel tank positioned in a fuel system of a vehicle, in a first condition, operating an evaporative emissions system selectively fluidically coupled to the fuel tank in a first mode to decrease pressure in the fuel tank;

in a second condition, during refueling the fuel tank, operating the evaporative emissions system in a second mode to increase pressure in the fuel tank; and in both the first condition and the second condition, indicating whether a variable orifice valve positioned in a vapor recirculation line upstream of a fuel tank isolation valve of the fuel system is degraded based on a rate at which a fuel vapor canister is loaded with fuel vapors during the decreasing pressure and the increasing pressure, respectively, wherein the fuel tank isolation valve is kept open in both the first condition and the second condition, wherein operating the evaporative emissions system in the first mode to decrease pressure in the fuel system includes duty cycling a canister purge valve positioned in a purge line to periodically fluidically couple the evaporative emissions system to an intake of an engine, and wherein operating the evaporative emissions system in the second mode to increase pressure in the fuel system includes duty cycling a canister vent valve positioned in a vent line to periodically seal the fuel system and evaporative emissions system from atmosphere.

9. The method of claim 8, wherein the variable orifice valve opens and closes to varying extents as a function of fuel system pressure; and wherein the first condition includes an indication that the variable orifice valve is not capable of closing to its maximal extent and wherein the second condition includes an indication that the variable orifice valve is not capable of opening to its maximal extent.

10. The method of claim 8, further comprising:

indicating the variable orifice valve is stuck in a high-flow configuration in response to the rate at which the fuel vapor canister is loaded with fuel vapors being outside of a first threshold difference from a first expected canister loading rate while operating the evaporative emissions system in the first mode; and indicating the variable orifice valve is stuck in a low-flow configuration in response to the rate at which the fuel vapor canister is loaded with fuel vapors being outside of a second threshold difference from a second expected canister loading rate while operating the evaporative emissions system in the second mode.

11. The method of claim 10, wherein the rate at which the fuel vapor canister is loaded with fuel vapors in both the first condition and the second condition is indicated based on a temperature change of the fuel vapor canister; and wherein the temperature change of the fuel vapor canister is compared to a first expected canister temperature rise profile in the first condition and a second expected canister temperature rise profile in the second condition.

12. The method of claim 11, wherein the first and second expected canister temperature rise profiles each modeled as a function of a maximum amount of fuel that can be added to the fuel tank and further as a function of a duty cycle of the canister purge valve or the canister vent valve.

13. The method of claim 12, wherein duty cycling the canister purge valve includes controlling a duty cycle of the canister purge valve so that the variable orifice valve closes to its maximum extent possible provided the variable orifice valve is not degraded; and wherein duty cycling the canister vent valve includes controlling a duty cycle of the canister vent valve so that the variable orifice valve opens to its maximum extent possible provided the variable orifice valve is not degraded.

14. The method of claim 8, wherein the variable orifice valve is one of passively mechanically actuated or electromechanically actuated as a function of fuel system pressure.

15. The method of claim 8, wherein operating the evaporative emissions system in the first mode and operating the evaporative emissions system in the second mode both occur during a same refueling event of the fuel tank.

16. A system for a vehicle, comprising:

a fuel system including a fuel tank and a fuel vapor recirculation line for recirculating fuel vapors back to the fuel tank;

a variable orifice valve positioned in the fuel vapor recirculation line upstream of a fuel tank isolation valve;

an evaporative emissions system fluidically coupled to the fuel system, the evaporative emissions system including a fuel vapor storage canister;

a canister purge valve positioned in a purge line selectively fluidically coupling the fuel vapor storage canister to an intake of an engine;

a canister vent valve positioned in a vent line selectively fluidically coupling the fuel vapor storage canister to atmosphere; and a controller with computer readable instructions stored on non-transitory memory that, when executed, cause the controller to:

during a refueling event, actively manipulate pressure in the fuel system via duty cycling either the canister purge valve or the canister vent valve while keeping the fuel tank isolation valve open; and indicate whether the variable orifice valve is degraded based on a rate at which the fuel vapor storage canister is loaded with fuel vapors during the actively manipulating pressure in the fuel system, wherein actively manipulating the pressure includes increasing the pressure by duty cycling a canister vent valve to periodically seal the fuel system and evaporative emissions system from atmosphere, or decreasing the pressure by duty cycling a canister purge valve to periodically fluidically couple the fuel system and the evaporative emissions system to an intake of an engine of the vehicle.

17. The system of claim 16, wherein the controller stores further instructions to:

indicate that the variable orifice valve is stuck in a high-flow configuration in response to the rate at which the fuel vapor storage canister is loaded with fuel vapors during duty cycling the canister purge valve being less than a first expected canister loading rate by more than a first threshold difference;

wherein the rate at which the fuel vapor storage canister is loaded with fuel vapors during duty cycling the canister purge valve is indicated based on a monitored temperature rise of the fuel vapor storage canister;

wherein the first expected canister loading rate is indicated based on a first expected temperature rise profile given a determined fuel fill rate; and wherein the first expected canister temperature rise profile is further modeled as a function of a maximum amount of fuel that can be added to the fuel tank and a function of a duty cycle of the canister purge valve.

18. The system of claim 16, wherein the controller stores further instructions to:

indicate that the variable orifice valve is stuck in a low-flow configuration in response to the rate at which the fuel vapor storage canister is loaded with fuel vapors during duty cycling the canister vent valve being greater than a second expected canister loading rate by more than a second threshold difference;

wherein the rate at which the fuel vapor storage canister is loaded with fuel vapors during duty cycling the canister purge valve is indicated based on a monitored temperature rise of the fuel vapor storage canister;

wherein the second expected canister loading rate is indicated based on a second expected temperature rise profile given a determined fuel fill rate; and wherein the second expected canister temperature rise profile is further modeled as a function of a maximum amount of fuel that can be added to the fuel tank and a function of a duty cycle of the canister vent valve.

* * * * *